US009914631B2

(12) United States Patent
Manwani et al.

(10) Patent No.: US 9,914,631 B2
(45) Date of Patent: Mar. 13, 2018

(54) CONTAINER FOR PRESERVING LIQUID CONTENTS

(71) Applicant: Kuvee, Inc., Boston, MA (US)

(72) Inventors: Vijay Girdhar Manwani, Lexington, MA (US); Duane Junior Gilbert, Quincy, MA (US); Geoffrey Blake Lansberry, Andover, MA (US); Nils Arnaud Teissier du Cros, Newton, MA (US); Adam Elliot Bercu, Somerville, MA (US); David Dolloff Chesley, Duxbury, MA (US)

(73) Assignee: Kuvee, Inc., Boston, MA (US)

( * ) Notice: Subject to any disclaimer, the term of this patent is extended or adjusted under 35 U.S.C. 154(b) by 212 days.

(21) Appl. No.: 14/675,095

(22) Filed: Mar. 31, 2015

(65) Prior Publication Data

US 2015/0284163 A1 Oct. 8, 2015

Related U.S. Application Data

(60) Provisional application No. 61/974,086, filed on Apr. 2, 2014, provisional application No. 62/128,341, filed on Mar. 4, 2015.

(51) Int. Cl.
*B65D 25/38* (2006.01)
*B67D 3/00* (2006.01)
(Continued)

(52) U.S. Cl.
CPC ..... *B67D 3/0077* (2013.01); *B65D 23/02* (2013.01); *B65D 25/16* (2013.01); *B65D 77/06* (2013.01);
(Continued)

(58) Field of Classification Search
CPC .. B67D 3/0029; B67D 3/0051; B67D 3/0061; B67D 3/0067; B67D 3/008;
(Continued)

(56) References Cited

U.S. PATENT DOCUMENTS 128,940 A * 7/1872 Banker et al. ..... B65D 77/065 222/183
2,999,500 A * 9/1961 Schurer ..... A61M 1/0011 128/DIG. 12
(Continued)

FOREIGN PATENT DOCUMENTS

EP 0330785 9/1989
EP 0874732 3/2003
(Continued)

OTHER PUBLICATIONS

ISA, "PCT Application No. PCT/US16/20962 International Search Report and Written Opinion dated May 17, 2016", 10 pages.
(Continued)

*Primary Examiner* — Patrick M Buechner
(74) *Attorney, Agent, or Firm* — Strategic Patents, P.C.

(57) ABSTRACT

A beverage container includes a flexible inside container and a rigid outside container. The flexible container can retain a liquid and seal the liquid from environmental air, while the surrounding rigid container facilitates handling and pouring in a form factor that reproduces the look and feel of a conventional wine bottle. A one-way valve permits pouring from the flexible container while preventing ingress of atmospheric oxygen or other contaminants. In particular, the one-way valve can be configured to retain a beverage within the flexible container until an exit path for the beverage through the valve is filled with liquid to seal the exit path and effectively eliminate any return path for ingress of air. To create a bottle-like pouring experience, the valve may automatically open to allow for the pouring of fluid when the
(Continued)

bottle is tilted, and the valve may automatically close at the end of a pour.

29 Claims, 13 Drawing Sheets

(51) Int. Cl.
*B65D 77/06* (2006.01)
*B65D 23/02* (2006.01)
*B65D 81/24* (2006.01)
*B65D 25/16* (2006.01)

(52) U.S. Cl.
CPC ..... *B65D 77/067* (2013.01); *B65D 81/24* (2013.01); *B67D 3/007* (2013.01); *B67D 3/0051* (2013.01); *B67D 3/0067* (2013.01)

(58) Field of Classification Search
CPC ..... B67D 3/0083; B67D 2001/0827; B65D 77/06; B65D 77/065; B65D 77/067; B65D 77/068; B65D 23/02; B65D 81/24
See application file for complete search history.

(56) References Cited

U.S. PATENT DOCUMENTS 4,330,066 A * 5/1982 Berliner ..... B65D 23/00 215/12.1
4,523,687 A 6/1985 Hullihen et al.
4,579,315 A 4/1986 Kowalski et al.
4,769,175 A * 9/1988 Inoue ..... D21H 17/63 204/484.1
4,856,680 A 8/1989 Sitton
4,984,713 A * 1/1991 Chambers ..... B65D 23/00 215/12.1
5,143,763 A * 9/1992 Yamada ..... A23L 3/3436 206/204
5,379,916 A 1/1995 Martindale et al.
5,467,806 A 11/1995 Stricklin et al.
5,516,007 A * 5/1996 Larson ..... B65D 1/0223 222/105
5,609,195 A 3/1997 Stricklin et al.
6,006,388 A 12/1999 Young et al.
6,036,055 A 3/2000 Mogadam et al.
6,109,468 A 8/2000 Kneer et al.
6,264,066 B1 7/2001 Vincent et al.
6,276,558 B1 8/2001 Kneer
6,412,659 B1 7/2002 Kneer
6,769,575 B1 8/2004 Long et al.
7,140,519 B1 * 11/2006 Kiser ..... B65D 49/04 215/17
7,802,703 B2 9/2010 Kiser
8,430,262 B2 4/2013 Corbett et al.
8,453,878 B2 6/2013 Palmquist et al.
8,663,419 B2 3/2014 Corbett et al.
8,807,377 B2 8/2014 Corbett et al.
9,212,041 B2 12/2015 Lamond et al.
9,284,177 B2 3/2016 Litto
2003/0226853 A1 12/2003 Hidle et al.
2005/0029285 A1 * 2/2005 Gay, III ..... G01F 11/082 222/1
2007/0214055 A1 9/2007 Temko et al.
2007/0262092 A1 11/2007 Tyski et al.
2008/0164289 A1 * 7/2008 Kiser ..... B65D 77/06 222/500
2009/0008356 A1 * 1/2009 Gadzic ..... B65D 47/265 215/310
2009/0108022 A1 4/2009 Huggins et al.
2010/0006603 A1 1/2010 Weinberg et al.
2011/0036846 A1 * 2/2011 Corbett ..... B65D 77/06 220/495.03
2011/0290757 A1 12/2011 Purdy et al.
2011/0290798 A1 12/2011 Corbett et al.
2012/0024897 A1 2/2012 Corbett et al.
2012/0145710 A1 6/2012 Corbett et al.
2012/0211516 A1 8/2012 Zapp et al.
2012/0248117 A1 10/2012 Corbett et al.
2013/0112688 A1 * 5/2013 Krikor ..... A23L 2/42 220/212
2013/0175235 A1 * 7/2013 Elsayyid ..... A61M 16/183 215/316
2013/0193020 A1 8/2013 Corbett et al.
2013/0211928 A1 8/2013 De Benito Secades et al.
2013/0245819 A1 9/2013 Davenport et al.
2014/0174634 A1 6/2014 Corbett et al.
2014/0252032 A1 9/2014 Corbett et al.
2014/0266575 A1 9/2014 Pelfrey et al.
2014/0346198 A1 11/2014 Bond
2015/0144653 A1 5/2015 Kline et al.
2016/0257554 A1 9/2016 Manwani et al.
2017/0015480 A1 * 1/2017 Slack ..... B65D 23/02
2017/0158485 A1 6/2017 Lansberry et al.

FOREIGN PATENT DOCUMENTS

GB 2426506 11/2006
WO WO-8903353 4/1989
WO WO-2006107403 10/2006
WO WO-2015153598 10/2015
WO WO-2016141322 9/2016
WO WO-2017096319 6/2017

OTHER PUBLICATIONS

WIPO, "PCT Application No. PCT/US15/23573 International Preliminary Report on Patentability dated Oct. 13, 2016", 9 pages.
ISA, "PCT Application No. PCT/US16/64849 International Search Report and Written Opinion dated Feb. 16, 2017", 9 pages.
"U.S. International Searching Authority, International Application Serial No. PCT/US15/23573, Search Report and Written Opinion dated Jul. 8, 2015", 11 pages.
Eisenman, Lum, "Oxygen Uptake in Wine", San Diego Amature Winemaking Society, News Articles [serial online]. 2012 [retrieved on Mar. 16, 2012]. Retrieved from the Internet: <URL:http://web.archive.org/web/20120316130000/http://www.sdaws.org/News/Articles/documents/Oxygen%20Updake%20in%20Wine.pdf>. , 5 pages.
USPTO, "U.S. Appl. No. 15/061,294 Non-Final Office Action dated Nov. 6, 2017", 19 pages.
EPO, "EP Application Serial No. 15773443.5 Supplemental Search Report dated Dec. 4, 2017", 6 pages.

* cited by examiner

CONTAINER FOR PRESERVING LIQUID CONTENTS

CROSS-REFERENCE TO RELATED APPLICATIONS

This application claims the benefit of U.S. Prov. App. No. 61/974,086 filed on Apr. 2, 2014 and U.S. Prov. App. No. 62/128,341 filed on Mar. 4, 2015, the entire contents of which are hereby incorporated by reference.

TECHNICAL FIELD

The disclosure relates to a container for preserving liquid contents, and more specifically to a pourable container for preserving oxidation-sensitive liquids.

BACKGROUND

Some beverages such as wine should be consumed shortly after exposure to the atmosphere due to sensitivity to oxidation that can rapidly degrade beverage quality. While there have been numerous attempts to preserve shelf life of such beverages after a first pour, existing techniques such as manual evacuating pumps or needles for resealably piercing a wine cork are generally complex or unsatisfactory, requiring numerous additional handling steps, while still exposing wine to atmospheric oxygen in a manner that can lead to quicker spoliation. Other wine delivery systems similarly offer unsatisfactory, incomplete solutions. For example, a bag-in-a-box form factor is bulky and awkward for use at a dining table. Other techniques such as a bag-in-a-bottle, permit a more natural pouring experience, but permit significant infiltration of air into a wine container during use.

There remains a need for a dispenser system that extends the shelf life of a pourable beverage.

SUMMARY

A beverage container includes a flexible inside container and a rigid outside container. The flexible container can retain a liquid and seal the liquid from environmental air, while the surrounding rigid container facilitates handling and pouring in a form factor that reproduces the look and feel of a conventional wine bottle. A one-way valve permits pouring from the flexible container while preventing ingress of atmospheric oxygen or other contaminants. In particular, the one-way valve can be configured to retain a beverage within the flexible container until an exit path for the beverage through the valve is filled with liquid to seal the exit path and effectively eliminate any return path for ingress of air. To create a bottle-like pouring experience, the valve may automatically open to allow for the pouring of fluid when the bottle is tilted, and the valve may automatically close at the end of a pour.

BRIEF DESCRIPTION OF THE DRAWINGS

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein.

DETAILED DESCRIPTION

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

In the following description, it is understood that terms such as "first," "second," "top," "bottom," "up," "down," and the like, are words of convenience and are not to be construed as limiting terms.

It will be understood that while the exemplary embodiments herein emphasize the preservation of wine, these techniques may be adapted for use with any fluid, particularly fluids with limited shelf lives and sensitivity to air exposure that are typically poured from a container such as alcohol, milk, juice (e.g., fruit or vegetable), water, and so forth, as well as other liquids that are not for drinking but might nonetheless be usefully preserved and poured in similar fashion.

Figure 1:
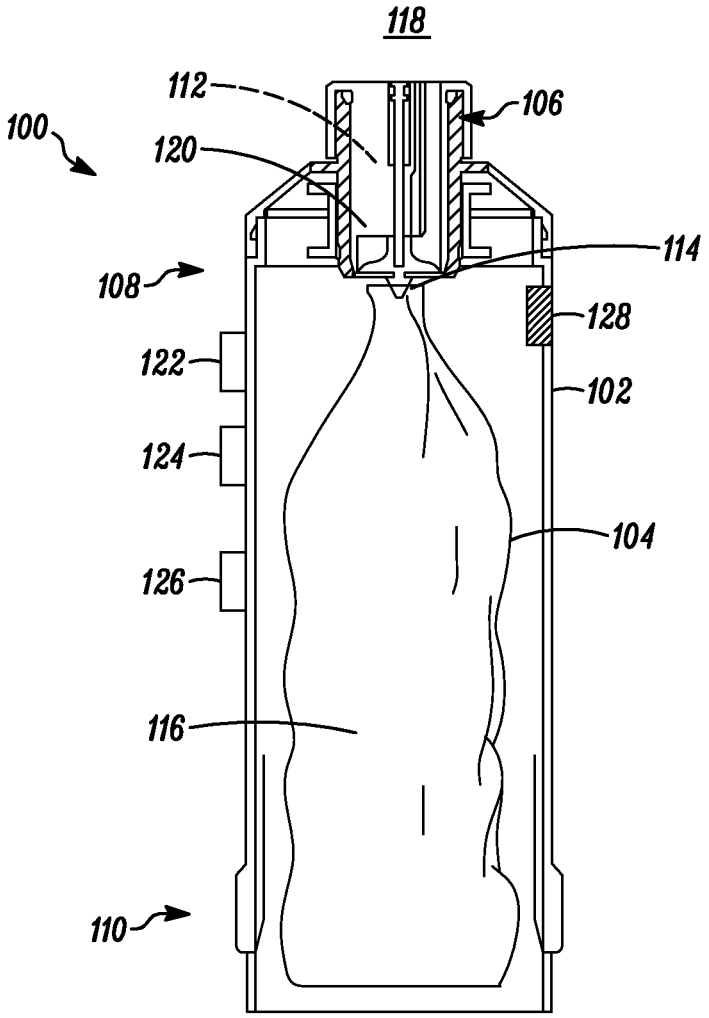
FIG. 1 is a cross-sectional view of a container.

FIG. 1 is a cross-sectional view of a container. In general, the container 100 may include a storage and dispensing unit designed for preserving its contents before, during, and after dispensing (e.g., pouring liquid contents therefrom). The container 100 may, for example, store and dispense a fluid such as any of those described above, e.g., wine or the like. The container 100 may include a rigid container 102, a flexible container 104, and a valve 106. In an aspect, the rigid container 102 houses the flexible container 104 to form a bag in a bottle.

The rigid container 102 may be formed as a bottle having a top 108, a bottom 110, and a first opening 112 on the top 108. The bottle may be shaped and sized to resemble, e.g., a wine bottle, a beer bottle, a water bottle, a jug, a thermos, a sports-drink bottle, a milk bottle, a flask, and so forth. Alternatively, the rigid container 102 may include other shapes useful for holding or decanting fluids including without limitation, a can-shape, a cone shape, a carton shape, a spherical or ellipsoid shape, a decanter shape, a pitcher shape, and so forth.

The rigid container 102 may be impermeable to air, and may be made from one or more materials including without limitation glass, plastic, metal (e.g., aluminum or steel), ceramic, cardboard, paper products, or any other material or combination of materials providing satisfactory shape, feel, and structural characteristics for uses as contemplated herein. The rigid container 102 may be substantially rigid to enforce a fixed size and shape thereby providing ease of storage, manipulation, and filling, while also protecting its contents.

The rigid container 102 may be made from one part or multiple parts, e.g., it may be divided and split in different locations, either vertically or horizontally, which allows for multiple modalities for manufacturing of the rigid container 102 and insertion of the flexible container 104 therein.

The flexible container 104 may be disposed inside the rigid container 102 when the container 100 is assembled, where the flexible container 104 includes a second opening 114 aligned to the first opening 112 to provide a fluid path from an interior 116 of the flexible container 104 through the first opening 112 of the rigid container 102 to an exterior environment 118. The flexible container 102 may be substantially bottle-shaped. The flexible container 102 may be made from one or more materials including a polyethylene plastic film or the like. In one aspect, the flexible container 102 includes a first liner with an oxygen permeability selected to reduce oxygen diffusion into the interior 116 of the flexible container 104, and a second liner providing an inert layer for contact with a beverage. In particular, the flexible container 102 may be made from a co-extruded film with two or more layers, where an inert layer is in contact with a beverage, and another layer provides an oxygen barrier. The flexible container 104 may instead include only one liner, e.g., a liner that can both reduce oxygen diffusion and provide an inert container for a beverage. The flexible container 104 may also or instead include a film or liner selected to minimize or eliminate the tainting of wine or removal of aromas (i.e., scalping). In other words, the flexible container 104 may be constructed such that it does not alter the aroma, taste, composition, color, and so forth of a fluid contained therein. The thickness of the flexible container 102 may be minimized to maximize collapsibility and minimize residual fluid remaining in the flexible container 102 after dispensing. The flexible container 104 may be elastic or inelastic, i.e., stretchable or non-stretchable. In one aspect, the flexible container 104 is a bag such as a flat welded bag or gusseted bag. More generally, the flexible container 104 may be appropriately designed and constructed in consideration of one or more of the following factors: flexibility, collapsibility, gas permeability, light transparency, sterility, inertness, temperature stability, heat-seal compatibility, recyclability, strength, and so forth.

The valve 106 may, for example, be a one-way valve disposed along the fluid path, i.e., between the interior 116 of the flexible container 104 and the exterior environment 118. The valve 106 may open so that a fluid can be poured from the interior 116 of the flexible container 104 at or above a predetermined tilt angle of the rigid container 102. The valve 106 may also or instead self-seal to resist a backflow of air when the rigid container 102 returns to a tilt angle below the predetermined tilt angle. In general, the term "tilt angle" is intended to refer to a deviation from a normal orientation. For example, the tilt angle may be measured from an upright vertical orientation (i.e., with the valve 106 on top), or from a horizontal orientation as wines or the like are typically stored. More generally, the particular reference angle or reference point for measuring a tilt angle is unimportant, provided that it gives a consistent reference for measuring an amount of tilt imposed on a bottle, e.g., as a pour is initiated or terminated from the bottle.

The flexible container 104 may provide a variable-volume vessel that shrinks or expands according to an amount of fluid contained therein. Thus the flexible container 104 may deflates as fluid is released through the valve 106. In one aspect, at least one of the rigid container 102 or the flexible container 104 may include a means for assisting the flexible container 104 to be resized, e.g., a movable piston, a pressurized roll-up feature (similar to a toothpaste tube), or any other suitable mechanism. Additionally, to ensure that no liquid is trapped in folds of the flexible container 104, and to prevent collapsing of the flexible container 104 when dispensing, the flexible container 104 may be attached (e.g., on the sides or bottom) to the rigid container 102 in any suitable manner and at any suitable location or combination of locations, e.g., via an adhesive or the like. For example an end of the flexible container 104 distal from the valve 106 may be secured to a similarly distal point on the interior of the rigid container 102 in order to prevent folding, creasing, or other undesirable collapse of the flexbile container 104 that might prevent fluid from exiting the interior 116.

The valve 106 may include a passive valve that opens at a cracking pressure (i.e., the pressure at which the valve 106 will open) selected to ensure that an opening of the valve 106 along the fluid path (e.g., the chamber 120 shown in the figure) is fully flooded whenever the valve 106 is open during a pour. In other words, the valve 106 may remain closed until fluid fills and closes off the path from the interior 116 to the exterior 118 in at least one location along the path so that air cannot infiltrate the interior 116 of the flexible container 104 along the fluid path. It will be appreciated that the tilt angle to achieve this cracking pressure and release fluid from the interior 116 will vary according to an amount of fluid in the interior 116, with a larger amount of fluid having a greater mass and applying greater pressure to the valve 106 so that the cracking pressure is exceeded with a smaller tilt angle. This general interaction usefully provides a tilt angle that increases as the amount of fluid decreases, thus mimicking the natural pouring action of a conventional wine bottle. By adjusting the cracking pressure, either by design or through manual adjustment during fabrication, a valve 106 may be obtained that achieves the dual design objectives of mimicking a natural pour and fully sealing at least some portion of the exit path with fluid during the pour.

While this general valve action may be achieved with a passive valve such as an umbrella valve, the valve 106 may also or instead include an active valve operable to automatically open the fluid path when the tilt angle exceeds a predetermined tilt angle selected to ensure that an opening 120 of the valve 106 along the fluid path is fully flooded. It will be noted that active components may achieve this function in a variety of ways. For example, the container 100 may include circuitry to detect an actual tilt angle and determine when to open the valve 106, e.g., based on a measured weight of fluid in the container 100 or an estimated mass of fluid based on, e.g., a history of pours from the container 100. As another example, the container 100 may include circuitry to measure a pressure on the valve 106 exerted by fluid during a tilt, or directly monitor the fluid path to determine when it is sufficiently flooded to prevent a backflow of air. As noted above, fully flooding the opening 120, or more generally some point along the fluid path, prevents a backflow of air into the interior 116 of the container 100, or more specifically, the interior 116 of the flexible container 104 inside the container 100.

The predetermined tilt angle may vary according to an amount of fluid in the interior 116 of the flexible container 104. The predetermined tilt angle may also or instead vary to prevent a backflow of air from the exterior environment 118 into the interior 116 of the flexible container 104 during pouring. In one aspect, the predetermined tilt angle is about three degrees from horizontal for a first pour when the interior 116 is full.

The valve 106 may also or instead be operable via a control mechanism 122 integrated into the rigid container 102 and operable to manually open the valve 106 during a pour. This manual operation may, for example, be complemented by automatic or passive valve control to ensure flooding of the fluid path, or this manual operation may override the operation of the valve 106 so that a user can decide to manually control pouring even if beverage contents might be compromised by an exposure to air. In one aspect, the control mechanism 122 includes a button or the like disposed on the rigid container 102, e.g., disposed near the top 108 of the rigid container 102 to permit control from a natural position for a finger or thumb during gripping and pouring.

The valve 106 may include one or more of an umbrella valve, a poppet valve, a check valve, a ball valve, a butterfly valve, a gate valve, a choke valve, a diaphragm valve, a pinch valve, and so forth. The valve 106 may include one or more separate valves or valve components that cooperate to obtain a desire mix of automated and manual control during pouring. For example, in one aspect, the valve 106 includes at least a first valve and a second valve. The first valve may include an umbrella valve and the second valve may include a poppet valve. In an aspect, the valve 106 includes a first valve that opens at a predetermined cracking pressure, and a second valve that is operable to manually close the fluid path and override operation of the first valve to seal the container 100 when not in use. In another aspect, the first valve is a passive valve that opens at a cracking pressure, and the second valve is operable to control a pour through the fluid path. For example, the second valve may be manually operable to close the fluid path when the device is not in use, or the second valve may operate to automatically control a pour through the fluid path in response to a sensed condition or the like.

The valve 106 may be engaged with one or more of the rigid container 102, the flexible container 104, or another component of the container 100, e.g., a component that couples the rigid container 102 and the flexible container 104. The valve 106 may be made from any suitable materials including without limitation one or more of plastic, rubber (or other elastomeric material), metal, and so forth.

The container 100 may include a processor 124 and a sensor 126 to control operation of the valve 106 and otherwise support use of the container 100. The processor 124 and sensor 126 may be disposed in any suitable location(s) in or on the container 100, such as on or within the rigid container 102, the flexible container 104, or the valve 106. The processor 124 may be configured to perform any suitable tasks associated with the container 100, such as to determine the amount of fluid in the flexible container 104 and to calculate the predetermined tilt angle at which to open the valve 106. The processor 124 may also or instead be configured to detect an actual tilt angle and operate the valve 106 according to the actual tilt angle and the predetermined tilt angle. The sensor 126 may be used for one or more of detecting or measuring an amount of fluid, detecting or measuring a property of the fluid (e.g., temperature, pressure, acidity, and so forth), detecting or measuring a tilt angle, or detecting or measuring any other useful property of the container 100, its contents, or components.

The container 100 may include an oxygen scavenger 128 disposed at any suitable location or combination of locations between the interior 116 and the exterior environment 118 in order to mitigate oxygen filtration into the interior 116 of the flexible container 100. For example, the oxygen scavenger 128 may be incorporated into the rigid container 102 as a coating inside or outside of the rigid container 102, or as a material distributed within the material used to fabricate the rigid container. In this manner the oxygen scavenger 128 can be engaged with the rigid container 102, or the materials that make up the rigid container 102 can be fortified with the oxygen scavenger 128 to further minimize oxygen permeation. This may be particularly useful if the rigid container 102 is made from plastic.

The oxygen scavenger 128 may be any oxygen absorber or the like suitable for remove or decreasing the level of oxygen within the interior 116 of the container 100. A variety of oxygen scavengers are known in the art for reducing oxygen in packaged goods, any of which may be adapted for use as the oxygen scavenger 128 contemplated herein. For example, an oxygen barrier resin such as ValOR® Active Bloc 100 from Valspar Corp. may be utilized. Other oxygen barriers are also possible. The oxygen scavenger 128 may also or instead be disposed on the flexible container 104, e.g., as a laminate or a coating, or distribute specifically around joints or seams in the flexible container 104, the valve 106, the rigid container 102, or joints or seams between any of the foregoing.

The container 100 may be shaped and sized to resemble a wine bottle, and the container 100 may be further designed to mimic the feel and user experience of a conventional wine bottle. For example, the container 100 may be shaped and sized to substantially reproduce a 750 ml wine bottle in form, feel, and/or weight. Additionally, the valve 106 may be configured to provide a natural pour for the fluid mimicking a pouring behavior of a standard wine bottle as described herein.

Figure 2:
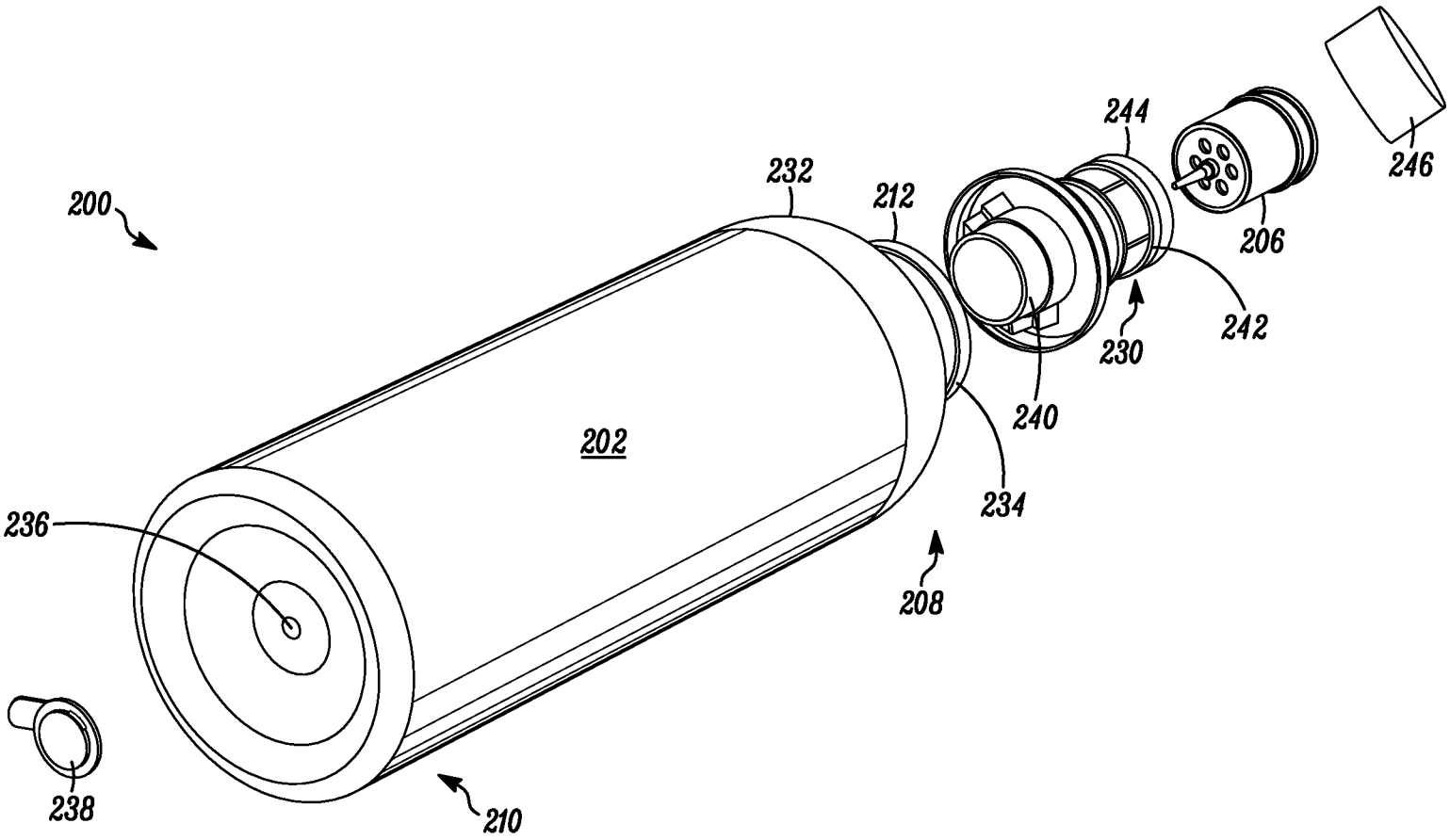
FIG. 2 is an exploded view of a container.

FIG. 2 is an exploded view of a container. The container 200 may be similar to that described above, and may include a rigid container 202, a valve 206, and a neck 230.

The rigid container 202 may be similar to that described above and may include a top 208, a bottom 210, and a first opening 212. As shown in FIG. 2, the rigid container 202 may be substantially bottle shaped, where the top 208 includes a sloped portion 232 leading to a collar 234 for engagement with the neck 230.

The rigid container 202 may further include a vent 236 to permit ingress of atmospheric air into the rigid container 202 as a fluid leaves a flexible container housed therein. As shown in FIG. 2, the vent 236 may be disposed on the bottom 210 of the rigid container 202. However, one skilled in the art will recognize that the vent 236 may also or instead be located elsewhere on the rigid container 202 as use of the container 200 permits. The container 200 may include a sticker 238 or the like disposed over the vent 236 to hermitically seal the vent 236 of the rigid container 202 prior to use. The sticker 238 may include or be replaced by another means for sealing the rigid container 202, e.g., a plug, a door, or the like. An oxygen scavenger such as any of the oxygen scavengers described herein may be usefully employed around seams of the sticker 238 to mitigate oxygen infiltration.

The neck 230 may be shaped and sized for engagement with the collar 234 of the rigid container 202. The engagement of the neck 230 to the rigid container 202 may form a hermetic seal with the first opening 212 such that a neck opening 244 on the top portion 242 of the neck 230 forms the only opening in the container 200, which if sealed then seals the container 200. The neck 230 may also be sized and shaped for engagement with a flexible container, such as any as described herein. In one aspect, a bottom portion 240 of the neck 230 is fitted to the top of a flexible container forming a hermetic seal with an opening of the flexible container such that the neck 230 acts as a fluid pathway into an interior of the flexible container.

The neck 230 may accommodate the valve 206, or a portion thereof, within its interior. The neck 230 may thus serve to couple the valve 206 and the container 200. The neck 230 may also or instead provide an interface to the dispensing and filling equipment for the container 200, such as a commercial wine bottle filling line.

The top portion 242 of the neck 230 may shaped and sized to accommodate a cap 246. For example, the top portion 242 of the neck 230 may include threads for engagement with an airtight screw cap disposed over the first opening 212 in the top 208 of the rigid container 202. The cap 246 may also or instead be press fit by a bottling system such as a wine bottling system to conform an interior of the cap 246 to an exterior surface of the neck 230 and form a sealed engagement there between.

Manufacturing of the container 200 as described above may include engaging the neck 230 to a flexible container. The neck 230 may then be placed on the top 208 of the rigid container 202 with the flexible container inserted into the rigid container 202. The neck 230 may then be press fitted or otherwise engaged with the rigid container 202. The interior of the flexible container may then be filled with a fluid in a bottling line or the like through the neck opening 244. Because of the configuration of the flexible container inside of the rigid container 202, the flexible container may be filled vertically in a bottling line (as opposed to being filled while lying substantially flat), which can enhance the reduction of headroom air in the filling process. The interior of the flexible container can thus be substantially filled to provide a headroom of air equal to or less than a conventional wine bottle, thus reducing the need to fortify wine with sulfites. After filling, the valve 206 may then be disposed in the neck 230, and the container 200 may be sealed with a cap 246 or the like. In this manner, the container 200 may be designed to be assembled and/or filled in a bottling line, e.g., a wine bottling line.

In an aspect, sealing the container 200 with the cap 246 may be performed by a bottle capper (e.g., a screw-capping machine) that also assists in the insertion of the valve 206 into the neck 230 of the container 200. For example, the valve 206 may be pre-positioned in the neck 230 and then the screw-capping machine applies a force (typically 400 pounds) to push the valve 206 into the neck 230 while simultaneously closing the container 200 with a tear away screw cap closure. In another aspect that supports screw-capping installation, the valve 206 may be pre-installed in a screw cap such that pre-positioning prior to screw-capping is not needed. Alternately, the valve 206 may be functional as a cork for the neck 230 where an additional cap is not desirable, and the valve 206 may be installed in a similar manner to a corking operation. Regardless, valve 206 installation may occur while the valve 206 is in an open position to allow the headroom air displaced during valve insertion to escape before the valve 206 is closed after installation. Pre-positioning and orientation of the valve 206 may also be incorporated into manufacturing techniques.

One skilled in the art will recognize that other manufacturing techniques may be utilized. For instance, the flexible container may be top loaded into the rigid container 202, bottom loaded into the rigid container 202, side loaded into the rigid container 202 (i.e., a clamshell design or similar), or the rigid container 202 and the flexible container may be manufactured as one integrated unit that requires no assembly. The rigid container 202 may also or instead include mechanical supports or the like for the flexible container.

One or more of the rigid container 202, the sloped portion 232, the collar 234, and the neck 230 may be specifically shaped and sized to be filled in a standard wine bottling line as known in the art. In this manner, the only additional step to traditional wine bottling may be to install the valve 206. Filling in a traditional bottling line may provide for an opportunity to limit headroom air, thus reducing sulphites added to a wine. In one aspect, the container 200 includes a wine having a sulfite content that is less than wine in a glass bottle, or comparable to wine in a glass bottle (as opposed to boxed wine sulfite contents, which are traditionally higher than those of glass bottled wines).

In one aspect, to be compatible with a wine bottling line as known in the art, the neck 230 has an inner diameter appropriate for accepting a filling tube (e.g., about 0.725 inches). Also, the outer diameter of the neck 230 may be appropriate to interface with a bottling line retaining ring (e.g., about 1.15 inches). The neck 230 may further include a ridge or lip on its top portion 242 that allows for a final sealing process to limit pressure on the container 200. In this manner, a sealing mechanism may grasp the neck 230 under the ridge and push the valve 206, where the neck 230 provides a countering force.

The design of the container 200 may provide for an increased shelf or storage life and, after the hermitic seal is broken, an extended dispensing or drinking life, particularly when used for wine preservation. To this end, because the rigid container 202 may be made from an impermeable material that is hermetically sealed until the moment when dispensing is initiated, and because of the inclusion of the valve 206 as described herein, the container 200 can offer improvements over prior art designs for both shelf life and dispensing life.

Once the container 200 is hermitically sealed, and prior to breaking the hermitic seal(s), e.g., by unsealing the cap 246 or removing the sticker 238, the container 200 may provide an extended shelf life. For example, after the cap 246 and the sticker 238 are placed on the rigid container 202 to seal the interior, the container 200 may be configured to maintain a decay of free sulfur dioxide in the wine—a consequence of oxidation—less than thirty percent in normal environmental conditions. An inverse figure of merit for wine preservation is the amount of dissolved oxygen in the wine, which is preferably maintained at a low level. In one aspect, the sealed container 200 may maintain an amount of dissolved oxygen less than one milligram per liter in a first twelve months in normal environmental conditions. While these levels of wine preservation provide satisfactory storage characteristics for many commercial applications, and compare favorably to some current alternatives such as a bag-in-a-box configurations, the container 200 contemplated herein can provide truly superior preservation performance after a first drink has been delivered from the container 200.

While convention wine bottles will last less than a day, and with a bit of labor such as an evacuation pump, may last several days, the container 200 described herein may preserve wine in a manner suitable for drinking and without loss of flavor for several weeks or more. In one aspect, the container 200 may maintain a decay of free sulfur dioxide in the wine less than sixty percent in the first two weeks after dispensing a drink and while stored in normal environmental conditions. In another aspect the container 200 may maintain an amount of dissolved oxygen in the wine less than one milligram per liter in these conditions. In other words, an embodiment provides a storage life of one or more years and a dispensing life of two or more weeks. This permits storage of unopened containers for an extended period up to or exceeding a year, and further facilitates gradual consumption of a wine or the like over time, reducing spoilage by preventing or reducing exposure to atmospheric oxygen.

Figure 3:
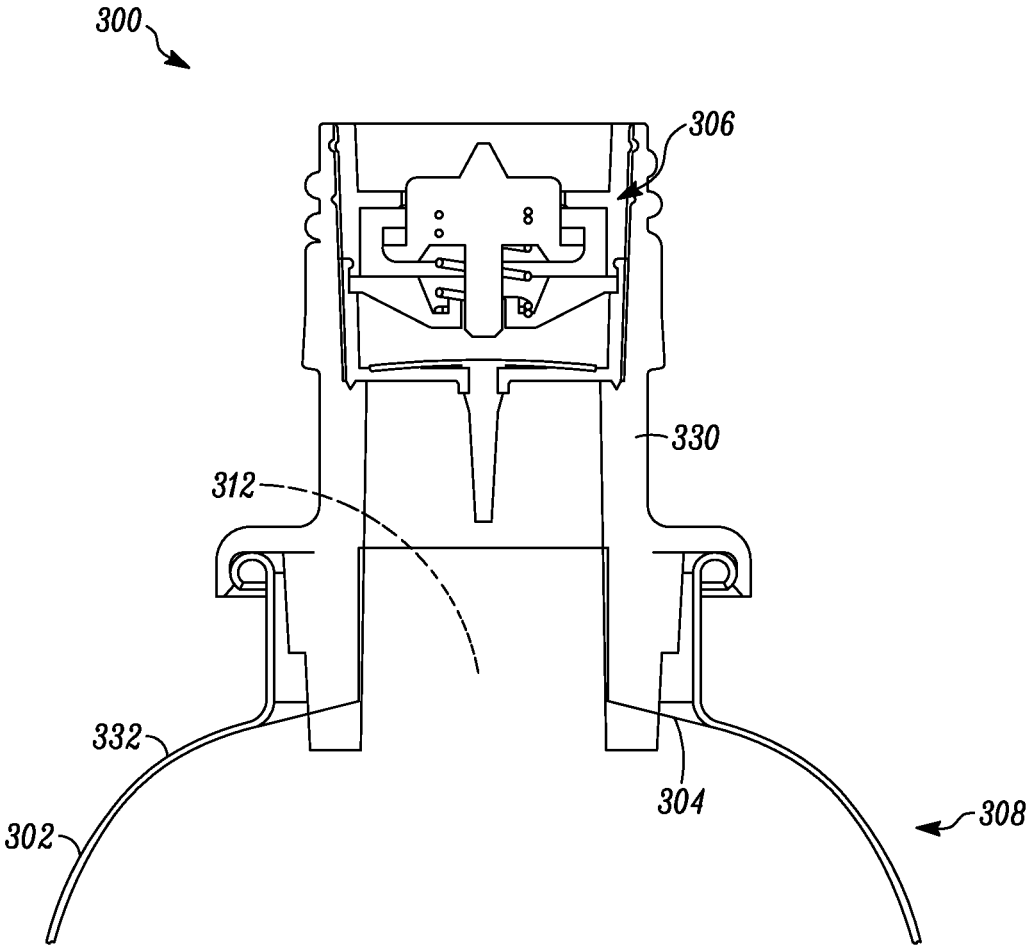
FIG. 3 is a cross-sectional view of a valve in a container.

FIG. 3 is a cross-sectional view of a valve in a container. Specifically, the container 300 of FIG. 3 includes the top 308 of a rigid container 302 having a sloped portion 332 and a first opening 312. FIG. 3 also shows a neck 330 fitted with a flexible container 304 and engaged with the rigid container 302. The container 300 also includes a valve 306 disposed in the neck 330.

The valve will now be discussed in more detail. In general, the valve used in the containers discussed herein may create a natural pouring action for the container. The valve may be passive, active, or any combination thereof. In one aspect, a fluid in the container can open the valve via gravity (i.e., passive activation). In another aspect, another active external force may open the valve, e.g., an electromechanical device with a controller or sensor that can detect tilt and open the valve (i.e., active activation). Either way, the valve can be used within the containers discussed herein such that a user's experience is similar to that of a normal wine bottle when pouring wine from the container.

Figure 4:
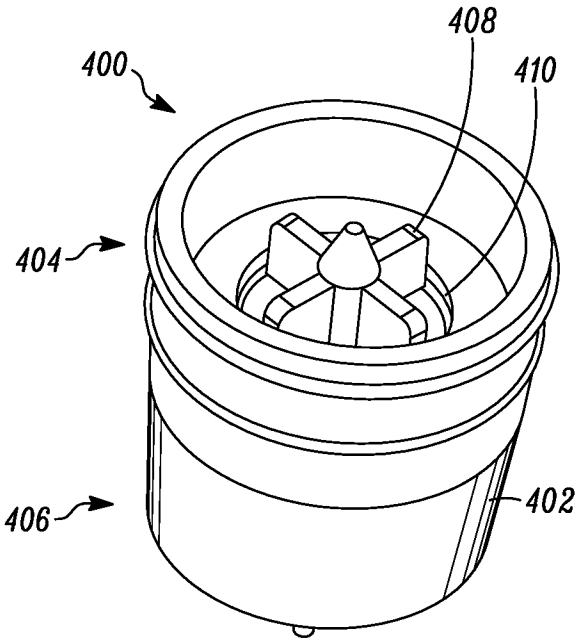
FIG. 4 is a top perspective view of a valve.

FIG. 4 is a top perspective view of a valve. The valve 400 may be any as described herein, and may include a valve body 402, a top 404, and a bottom 406. The valve 400 may include a poppet valve 408 that is capable of plugging and unplugging an aperture 410 on the top 404 of the valve 400. Plugging and unplugging the aperture 410 may thus be accomplished through movement of the poppet valve 408, e.g., linearly (up and down) or radially (twisting). The poppet valve 408 may be controlled by one or more of, e.g., pushing down with a predetermined force on the poppet valve 408 (or another component of the valve 400 or container), pulling the valve 400, twisting the poppet valve 408 (or another component of the valve 400 or container), squeezing a portion of the valve 400 or container, a manual control (e.g., a push button, a screw, a pin, a rotational device, or the like), an electromechanical device with a controller or sensor (e.g., to sense a tilt of the container and open the poppet valve 408 accordingly, or to sense a potential spill and close the poppet valve 408 accordingly), and so forth. Any of the above actuation interfaces can be driven by, e.g., a manual mechanism or an active component such as a pneumatic actuator, an electrically-driven device, a gravity-powered mechanism, and so forth.

Figure 5:
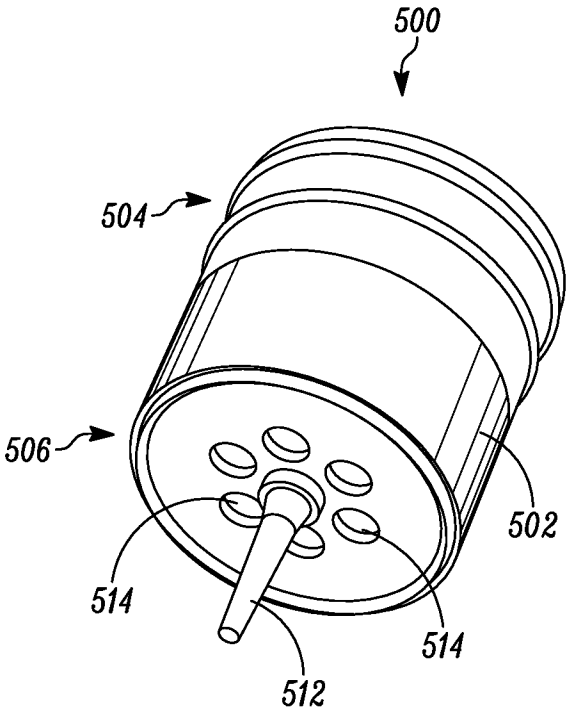
FIG. 5 is a bottom perspective view of a valve.

FIG. 5 is a bottom perspective view of a valve. The valve 500 may be any as described herein, and may include a valve body 502, a top 504, and a bottom 506. The valve 500 may include an umbrella valve 512 that is capable of sealing an unsealing one or more holes 514 disposed on the bottom 506 of the valve 500 that provide a fluid path through the valve 500. The umbrella valve 512 may be a passive valve that opens at a cracking pressure selected to ensure that the interior of the valve body 502 of the valve 500 is fully flooded whenever the valve 500 is open, e.g., during a pouring operation of the container. In this manner, the umbrella valve 512 acts as a one-way check valve that allows fluid to enter through the holes 514 at a cracking pressure (e.g., caused by the weight of fluid when the container is tilted), but prevents air and fluid from flowing back through the holes 514 when pressure is below the cracking pressure. (e.g., the container is substantially upright, or at a tilt angle below a predetermined threshold for pouring).

The cracking pressure may be selected such that, when the valve 500 is engaged with a container filled with fluid, the umbrella valve 512 opens when the container is tilted at or above a predetermined tilt angle, which can vary according to the amount of the fluid in the container. The umbrella valve 512 valve may also or instead self-seal to resist a backflow of air (or fluid) when the container returns to a tilt angle below the predetermined tilt angle.

The one or more holes 514 disposed on the bottom 506 of the valve 500 may be arranged in a radial pattern encompassing 360 degrees around an axis of the valve 500 as shown in the figure so that the valve 500 can open at the desired tilt angle or cracking pressure independent of rotational orientation about an axis of the container or valve. The fluid path may also be generally radially symmetrical in order to similarly facilitate rotation-independent filling of the fluid path to prevent air infiltration.

Figure 6:
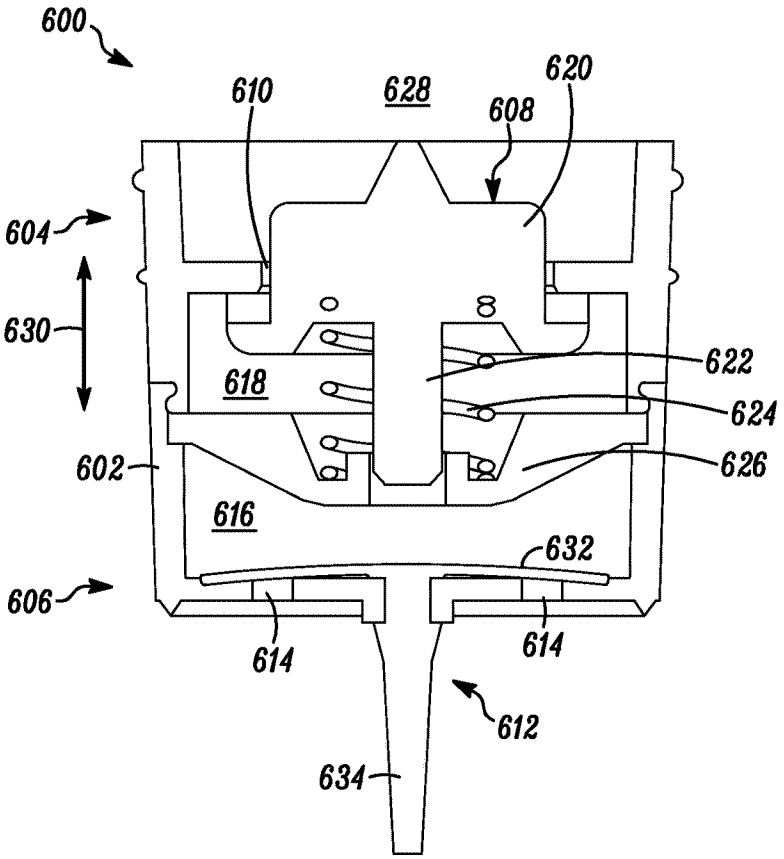
FIG. 6 is a cross-sectional view of a valve in a closed state.

FIG. 6 is a cross-sectional view of a valve in a closed state. The valve 600 may be any of the valves described herein, and may for example include a valve body 602, a top 604, a bottom 606, a first valve 608 (e.g., a poppet valve), an aperture 610, a second valve 612 (e.g., an umbrella valve), and one or more holes 614. As shown in the figure, the valve 600 is in a closed state where the holes 614 in the second valve 612 are completely covered by an umbrella and the aperture 610 is completely closed by the second valve 608.

In general, the valve 600 may include two distinct valves that cooperate to seal a fluid such as wine while not in use and permit pouring of the wine as desired. In one aspect the first valve 608 may be a poppet valve or the like that functions like a removable and replaceable cork, while the second valve 612 may be an umbrella valve or the like that functions as a one-way check valve to prevent infiltration of air during and after pouring.

The valve body 602 of the valve 600 may include a chamber, and more specifically a first chamber 616 and a second chamber 618. The first chamber 616 and the second chamber 618 may be in fluid communication thereby forming a large singular chamber. In another aspect, the first chamber 616 and a second chamber 618 may be separate, distinct chambers within the valve 600.

Where the first valve 608 is a poppet valve as shown in the figure, the first valve 608 may include a head 620, a stem 622, a spring 624, and a base 626 that cooperate such that the first valve 608 functions like a cork for the aperture 610 (and, in some instances, the container as a whole).

The head 620 of the first valve 608 may hermetically seal the aperture 610 thereby isolating the chamber of the valve 600 (and more specifically the first chamber 616 of the valve 600) from the exterior environment 628. The head 620 may be movable within the valve 600, e.g., axially in the direction shown by the arrows 630. The head 620 may also or instead be rotatable within the valve 600, e.g., for locking an axial position of the head 620 within the valve 600. Other locking means are also possible for locking a position of the first valve 608 within the valve 600, e.g., a toggle or the like. These locking means may secure the valve 600 during transportation, prevent contamination during storage and handling, and so forth. The locking means may also or instead lock the valve 600 in an open, or partially open state.

The stem 622 may be used within the valve 600 to align and position the spring 624 for engagement with the head 620 and the base 626. The stem 622 may also or instead engage the base 626. In an aspect, movement of the stem 622 provides fluid communication between the first chamber 616 and a second chamber 618. In one implementation, the stem 622 may plug a portion of the valve 600, e.g., the base 626 in order to separate the first chamber 616 and the second chamber 618.

The spring 624 may provide a force to the head 620 to keep the poppet valve closed such that the aperture 610 is sealed and the chamber of the valve 600 is isolated from the exterior environment 628. In use, when a predetermined force is applied to the head 620 of the poppet valve, e.g., a downward force, the spring 624 may compress thereby allowing movement of the head 620 in the downward direction and unsealing the aperture 610 exposing the chamber of the valve 600 to the exterior environment 628. When the predetermined force is released, or the poppet valve is otherwise unlocked to return to a closed state, the spring 624 may expand and push the head 620 upward to seal the aperture 610 thereby providing a restorative force for the poppet valve. Although the spring 624 is shown as a coil spring in the figures, a person skilled in the art will recognize that the spring 624 may also or instead include another type of spring or energy storage mechanism capable of providing a force to keep the aperture 610 sealed when the valve 600 is in a closed state and the poppet valve is not being actuated with the predetermined force.

The base 626 may be stationary within the chamber of the valve 600, and may divide the valve into the first chamber 616 and the second chamber 618. The base 626 may include fluid pathways to provide fluid communication between the first chamber 616 and the second chamber 618. The base 626 may provide a stationary engagement area for an end of the spring 624 where the spring 624 is disposed between the base 626 and the head 620 of the poppet valve. In an alternate embodiment, the base 626 is movable within the valve 600.

The second valve 612 may include an umbrella valve as shown in the figure. The umbrella valve may include a top portion 632 and a bottom portion 634. The umbrella valve may seal the holes 614 of the valve 600 in the closed state thereby preventing fluid from entering the chamber of the valve 600 (and more specifically the second chamber 618 of the valve 600) from a container disposed below the valve, e.g., a flexible container. The umbrella valve may similarly prevent fluid and air trapped within the chamber of the valve 600 from returning to the container when in a closed state. In general, the umbrella valve may be calibrated at a cracking pressure, such that the weight of a certain amount of fluid (e.g., wine) can open the top portion 632 of the umbrella valve during pouring.

The top portion 632 of the umbrella valve may resemble the top of an umbrella for which the valve is named. When disposed in a sealed position, as shown in FIG. 6, the top portion 632 may be disposed over the holes 614 thereby sealing them to create a separation between the chamber of the valve 600 and the container, e.g., a flexible container connected to the bottom 606 of the valve 600.

The bottom portion 634 of the umbrella valve may resemble a stem that protrudes through the bottom 606 of the valve 600. The bottom portion 634 may position the umbrella valve within the valve 600 and prevent axial displacement of the umbrella valve. The engagement between the umbrella valve 612 and the valve 600 may thus be facilitated by the bottom portion 634, e.g., through an interference fit or the like.

While in the closed state, the valve 600 may include fluid, e.g., wine or the like, disposed within the chamber of the valve 600. This may be beneficial to the long-term functionality of the umbrella valve 612. Although fluid may be disposed within the chamber of the valve 600, the poppet valve 608 may provide a visually clean appearance. Also, after a pouring operation when the container is straightened, fluid captured on the top 604 of the valve 600 can funnel back into the chamber through the aperture 610. A top surface of the valve 600 may include appropriate sloping to accommodate this funneling. The first valve may then be sealed with fluid in the chamber, which maintains the second valve (e.g., keeps it wet), prevents fluid (e.g., wine) from molding or the like, ensures that fluid does not spill, e.g., while swapping containers (e.g., when using a 'smart container' system as contemplated herein), and ensures that the containers can be stored in a refrigerator or the like without the fluid within the valve 600 drying out, which could limit the lifespan of the second valve 612. Because it may be detrimental for the umbrella valve to dry out, it may be desirable for the chamber to provide a relatively large volume along the fluid path between the first valve 608 and the second valve 612. Alternatively, the first or second valve may be designed to resist deterioration under dry conditions, e.g., through the selection of durable materials.

Figure 7:
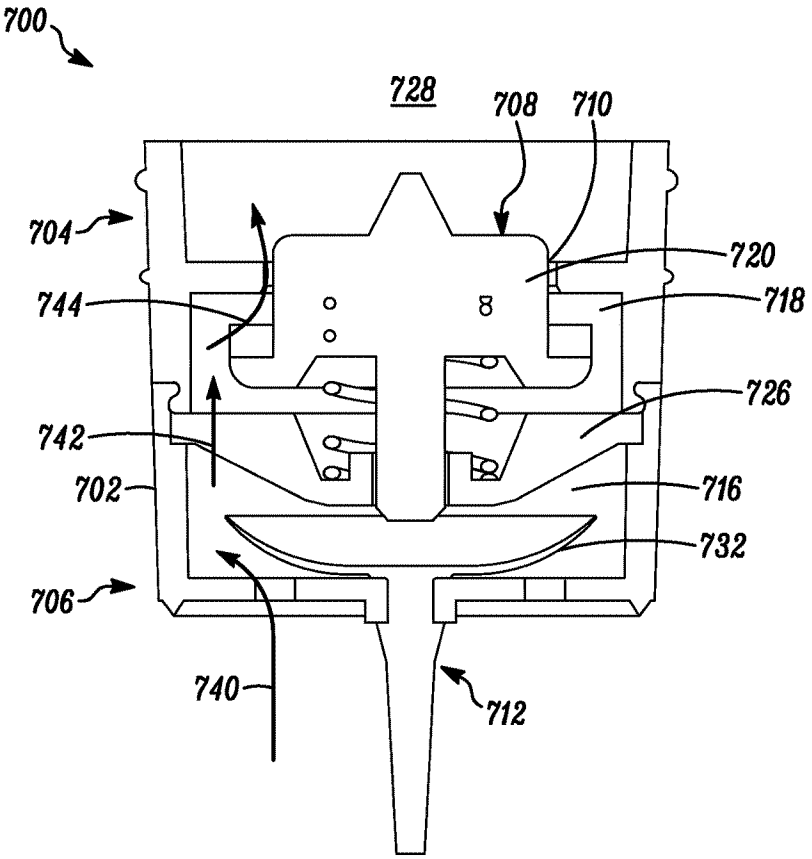
FIG. 7 is a cross-sectional view of a valve in an open state.

FIG. 7 is a cross-sectional view of a valve in an open state. The valve 700 may be any as described herein, and may include a valve body 702, a top 704, a bottom 706, a first valve (e.g., a poppet valve 708), an aperture 710, a second valve (e.g., an umbrella valve 712), and one or more holes 714. As shown in the figure, the valve 700 is in an open state where the holes 714 create a fluid pathway to a volume below the valve 700, and the aperture 710 is open by the poppet valve 708 thereby creating a fluid pathway from the chamber of the valve 700 to the exterior environment 728.

The open state of the valve 700 in FIG. 7 may be provided through actuation of the poppet valve 708 and actuation of the umbrella valve 712. The poppet valve 708 and the umbrella valve 712 may be actuated in separate, distinct steps, or they may be actuated together.

Actuation of the poppet valve 708 may be accomplished through applying a predetermined downward force on the poppet valve 708 thereby displacing the head 720 from a first position where it is sealing the aperture 710 to a second position where the aperture 710 creates a fluid pathway between the chamber of the valve 700 (and more specifically the second chamber 718 of the valve 700) and the exterior environment 728. Movement between the first position and the second position may include axial movement of the head 720 sliding at least partially into the valve body 702. Actuation of the poppet valve 708 may also or instead include a manual control (e.g., a push button on the container, the valve body 702, or elsewhere), an automatic electromechanical device having a sensor that detects tilting and opens accordingly (the device may also or instead detect a potential spill and close the poppet valve 708), and so forth.

Actuation of the umbrella valve 712 may be accomplished through application of a cracking pressure that lifts the top portion 732 of the umbrella valve 712 and creates a fluid pathway through the one or more holes 714 from a container below the valve 700 into the chamber of the valve 700 (and more specifically the first chamber 716 of the valve 700). The cracking pressure may be provided by the weight of a fluid applied to the top portion 732 of the umbrella valve 712 through the holes 714 when the container including the valve 700 is tilted at or above a predetermined tilt angle, where the predetermined tilt angle varies according to an amount of the fluid in the container. When the container is straightened, the fluid no longer applies the cracking pressure to the top portion 732 of the umbrella valve 712 and the umbrella valve 712 may self-seal to resist a backflow of air and fluid when the container returns to a tilt angle below the predetermined tilt angle.

A path of the fluid through the valve 700 during a pouring operation will now be described.

When the valve 700 is in an open state, and a container including the valve 700 is tilted at or above a predetermined tilt angle such that fluid provides a cracking pressure to the top portion 732 of the umbrella valve 712, the top portion 732 of the umbrella valve 712 flips upward as shown in FIG. 7, and fluid can travel in the direction shown by the first arrow 740, i.e., through the holes 714 and into the first chamber 716. The fluid may then travel through cavities/pathways in the base 726 of the poppet valve 708, i.e., from the first chamber 716 to the second chamber 718 as shown by the second arrow 742. The fluid may then travel from the second chamber 718 through a fluid pathway created by the axial position (i.e., open position) of the head 720 of the poppet valve 708 out of the aperture 710 and into the exterior environment 728 as shown by the third arrow 744.

Figure 8:
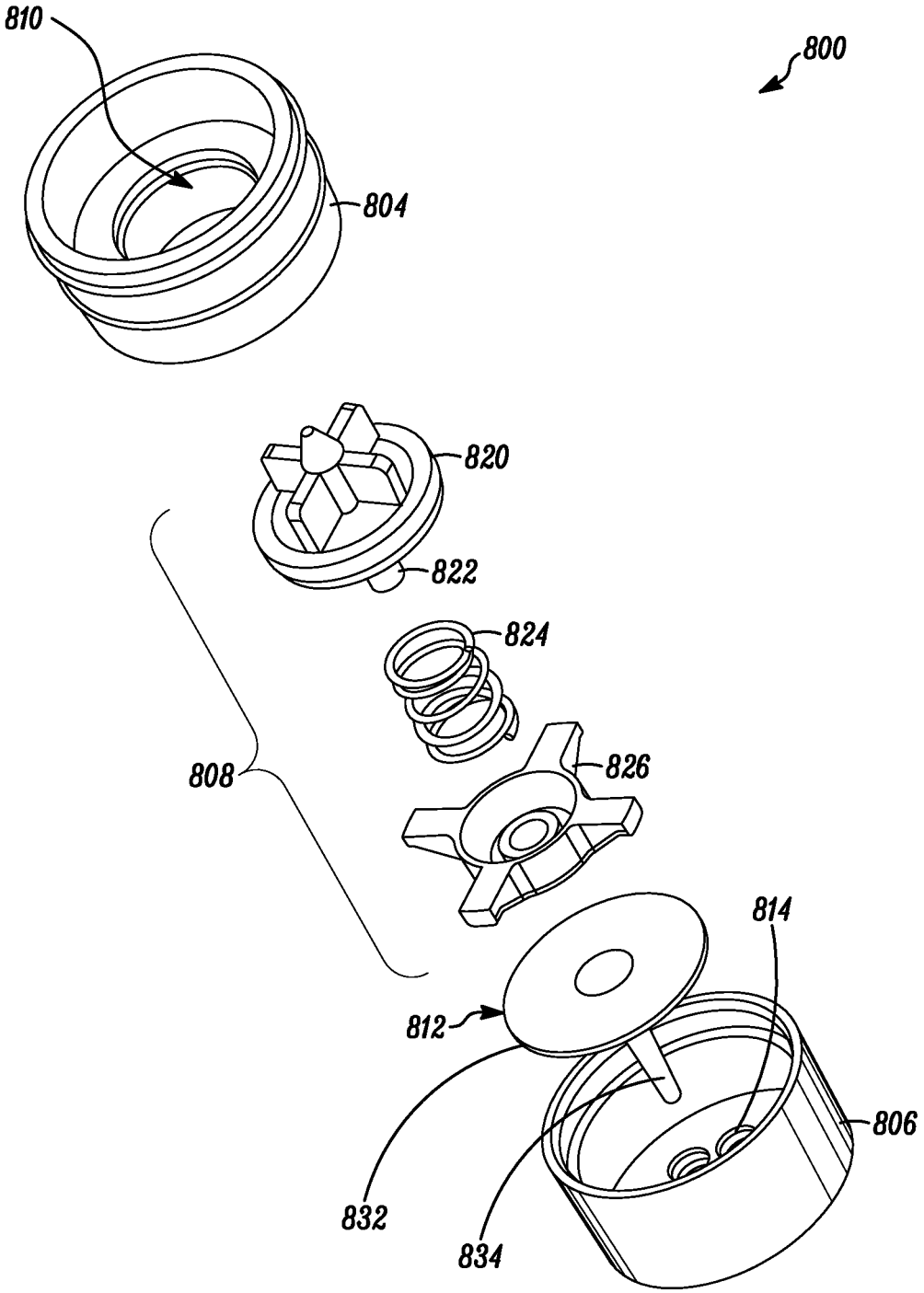
FIG. 8 is an exploded view of a valve.

FIG. 8 is an exploded view of a valve. The valve 800 may be any as described herein, and may include a valve body having a top 804 and a bottom 806, a first valve (e.g., a poppet valve 808), an aperture 810, a second valve (e.g., an umbrella valve 812), and one or more holes 814.

The poppet valve 808 may include a head 820, a stem 822, a spring 824, and a base 826. The umbrella valve 812 may include a top portion 832 and a bottom portion 834.

The valve as contemplated herein and as described above with reference to the figures may, in general, include a first valve that functions like a cork, where a container including the valve is closed (i.e., hermetically sealed), e.g., during storage or transportation. While in an open position, the first valve may allow a second valve to perform the function of pouring a fluid of the container while resisting the backflow of air from the outside environment.

In another aspect, it is possible to deliver the functionality of both storage and pouring while resisting backflow with only a first valve, e.g., a poppet valve. In this embodiment, the poppet valve may be opened at a tilt angle selected to ensure that the valve body is flooded with fluid during pouring, and as such, only fluid can flow out of the valve while air cannot flow into the cartridge. The function of such a valve can be provided by an electromechanical mechanism (e.g., a motor) that opens and closes the poppet valve when the appropriate tilt angles are detected in the act of pouring.

In yet another aspect, it is possible to deliver the functionality of both storage and pouring while resisting backflow with an umbrella valve or the like that is used in conjunction with a cap, e.g., a tear-away screw cap. In this embodiment, the cap may protect the fluid during storage and transportation. After the cap is removed, the pouring (tilting) action may create the cracking pressure necessary to open and pour the fluid through the umbrella valve, while still resisting a backflow of air. Straightening the container (untilting) may close the umbrella valve.

Implementations described herein may provide a desired balance between cracking pressure, flow rate, and residual fluid within the container and valve. For example, excessive cracking pressure may equate to excessive residual fluid. In contrast, not enough cracking pressure may create the risk of the backflow of air.

As described below, a container may include a housing that integrates a variety of features for a richer consumer experience.

Figure 9:
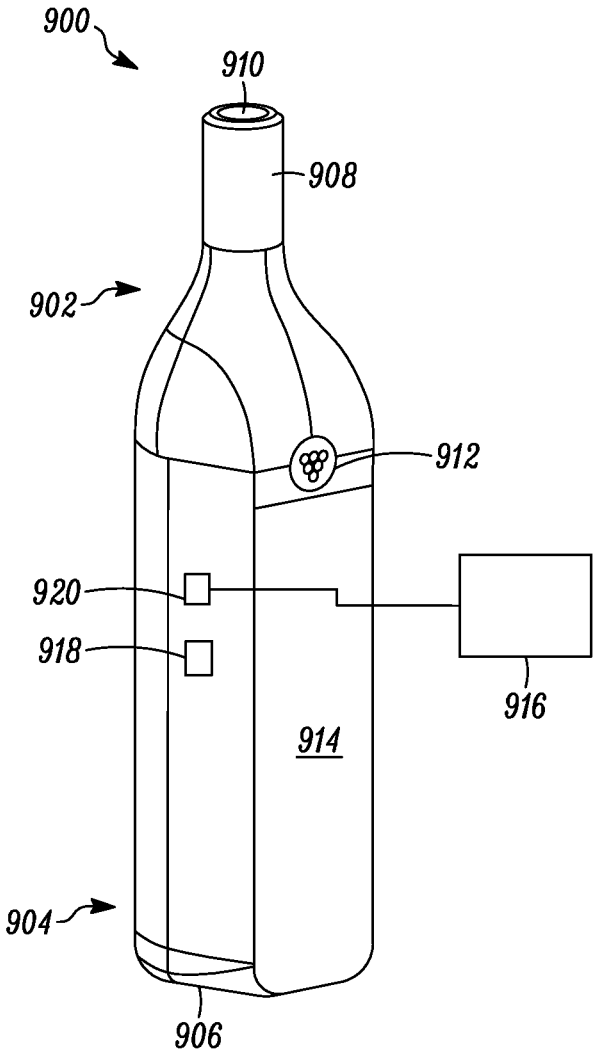
FIG. 9 shows a housing for a container system.

FIG. 9 shows a housing for a container system. In general the housing 900 may be a device that removably and replaceably receives a container and cooperates with the container for use in beverage enjoyment. In one aspect, the container is inserted into the housing 900 for dispensing wine or the like. As shown in the figure, the housing 900 may resemble a typical wine bottle design, and can also include a similar weight and handling properties.

The housing 900 may be configured to accept and cooperate with a container (such as any of the containers described herein), recognize the container, and display information relating to the contents of the container on a display. The housing 900 may include electrical and mechanical elements to provide useful features, including without limitation, metering how much fluid is dispensed, controlling how much fluid is being poured out of the container, estimating or tracking the amount of fluid remaining in the container, and so forth.

The housing 900 may include a top end 902 and a bottom end 904. The housing 900 may be shaped and sized to receive a container, such as the rigid container described above. The rigid container may be removably and replaceably coupled to the housing 900, e.g., through an opening 906 in the bottom end 904 of the housing 900. This design may facilitate modular, concurrent use of multiple containers with different fluids contained therein. When engaged, the housing 900 may enclose a majority of the rigid container.

The housing 900 may also include a spout-shaped accessory 908. The spout-shaped accessory 908 may be removably and replaceably coupled to the rigid container, where the spout-shaped accessory 908 is shaped and sized to attach to and enclose the opening of the rigid container. The spout-shaped accessory 908 may include a spout opening 910 along the fluid path to facilitate pouring of the fluid from the interior of the container. The spout-shaped accessory 908 may interface with the container and isolate the fluid path. The spout-shaped accessory 908 may be removable and washable.

The housing 900 may include a control 912 to manually eject a container included in the housing 900. The control 912 may also or instead be used to open and close a valve of the container system (or a separate control may be used for manually controlling the valve or performing other functions). As shown in the figure, the control 912 may include a push button or the like.

The housing 900 may include a display 914, e.g., a touch screen or the like in place of a label. Included within the display 914, or in addition to or in lieu of the display 914, the housing 900 may include a content delivery platform expressed through an LCD display, LED display, OLED display, or other display, which can receive updates through any suitable communications interface. Alternatively, a server 916 or the like may provide back end services to the housing 900.

The server 916 may support delivery of any traditional content to the housing 900 and its display 914, as well as social networking content and the like. A communications interface 920 of the housing 900 may also or instead support a data feed from the housing 900 to the server 916 in order to track user preferences, usage data, purchase orders, and so forth. The housing 900 may also or instead passively monitor the amount of fluid being dispensed using any suitable techniques such as accelerometer data and a pouring algorithm.

In general, the housing 900 may be part of a 'smart container' system. In particular the housing 900 may be a Wi-Fi connected device that has sensors to recognize a wine or the like contained therein (e.g., via radio frequency identification (RFID) or the like). The housing 900 may also or instead include one or more of the following features: it can display its label or other pertinent information via the display 914, it can sense and display its ideal drinking temperature, it can measure and control the amount of fluid that is poured (e.g., the housing 900 is capable of free pours or measured pours—1 to 2 oz for tasting, 5 oz for a glass, etc.), and so forth. The spout-shaped accessory 908 may include features to facilitate the elements of the smart container system.

In order to deliver appropriate, relevant content, the housing 900 may identify the container using a variety of different techniques. For example, the container may include an RFID tag or other technology for wirelessly delivering identifying information to the housing 900. A sensor, such as an infra-red (IR) break-beam or the like, may detect when a container has been inserted into the housing 900 so that the housing 900 knows to start scanning for information such as by looking for an RFID tag via a RFID receiver. RFID tags can conveniently alleviate any need for a separate power supply on the container, but other techniques may also or instead be used for short range wireless communications including without limitation BlueTooth, WiFi (or any other species of 802.11 communications), Near Field Communications, and so forth. A contact solution may also or instead be employed, such as identifying chips (much like that in printer cartridges) that identify containers and provide supplemental information about their contents. In one aspect, the RFID tag or identifying chip on the container may include a memory such as a non-volatile memory that can store variable information such as a temperature history or an amount of beverage remaining in the container. An amount of remaining beverage can be downloaded to the housing 900 when coupled to the container, and may be displayed by the housing 900 or otherwise used to manage pouring, display information, or otherwise control operation of the housing 900.

While a variety of suitable wireless techniques for transmitting information are available, other techniques may also or instead be employed. In one aspect, a bar code, QRC symbol, OCR-readable text, or the like may be placed on an exterior of the container in a location where it can be scanned by the housing 900 when the container is inserted therein. In another aspect, a number of electrical contacts in a plug, cradle, or the like may be provided so that the housing 900 can electrically couple to and communicate with the container. In this latter implementation, power may also be provided from the housing 900 to the container via one or more power contacts. In another aspect, particularly useful where a small number of varieties of beverages are used, the container may be mechanically encoded so that the housing 900 can determine contents of the container based on a mechanical engagement with the housing 900. Any technique for encoding information in this manner may be used such as a series of bumps, ridges, holes, slots, or other mechanical features, and combinations of the foregoing.

From a content delivery perspective, the container being inserted into the housing 900 may be identified, either via RFID or some other method, so that the corresponding label and corollary content can be displayed. The communications interface 920 may include WiFi, BlueTooth, cellular, WiMax, or the like in order to deliver data to a remote server 916 and receive data from same. For example, the housing 900 may deliver purchase requests and consumption data, which may be delivered at any level of granularity. For example, consumption data may track when a container is emptied or replaced, when a drink is dispensed, how much liquid was dispensed, and so forth. At the same time, the housing 900 may receive content, such as detailed information about a particular wine (geography, aging, history, grapes, alcohol content, weather information for the winery or other conditions that might affect wine flavor, serving suggestions (temperature, breathing, and so on), reviews, social network content, commercial content from a vintner, etc.). The housing 900 may also store local information relevant to wine consumption such as current wine temperature, air temperature, amount of beverage remaining, time since the container was first breached, and so forth. Any or all of this information may be presented in the display 914, which, as discussed above, may include a touch screen or other user interface control so that a user of the housing 900 can navigate to relevant information, make purchases, provide feedback or ratings, and so forth.

The foregoing may be advantageously configured for an alignment-independent communications interface that can operate independently of the rotational alignment of a container inside the housing 900. The container may also or instead be mechanically keyed to enforce a specific rotational alignment during insertion. Proper insertion of the container into the housing 900 can be ensured through feedback, e.g., mechanical (a 'click' or the like) or otherwise.

In one aspect, the information may provide or enhance a 'story' behind the fluid being dispensed (e.g., wine, craft beer, and so forth). Thus, a 'smart label' may be provided on the display 914 of the housing 900 for displaying such information. The housing 900 may download the information from a remote server 916 or read information from a container, and present this information in a multi-page or multimedia presentation which may include interactive content delivered, e.g., through a touch screen or the like in which a user can navigate within a user interface supported by the smart label to learn a story behind a wine. Other information generally or specifically related to a fluid may also or instead be provided. This may include without limitation recommended food pairings, recipes, serving suggestions, similar wines, and so forth.

Similarly, some beverages are better consumed if decanted for a period of time after being dispensed. In this case, the housing 900 can alert the user with information on how long the beverage should be decanted.

The housing 900 may include a memory 918. The memory 918 may store data including without limitation user feedback, ratings, notes or the like, which may be retained for private use by the consumer or shared in a social networking platform. This data may also be used, e.g., with the consumer's permission, to provide recommendations of wines with similar tastes, pricing, marketing information/offers, and so forth.

In another aspect, the housing 900 may be used to manually, automatically, or semi-automatically order replacement beverages based on a user's consumption history. Thus, the housing 900 may operate as a home wine management device that, e.g., determines when a container has been finished and proactively inquires whether the consumer would like to order another container. The consumer may also, either using the smart label interface or separately in a web interface for the server 916 or the like, establish a collection of favorites that can be automatically re-ordered when nearing completion of the container.

Figure 10:
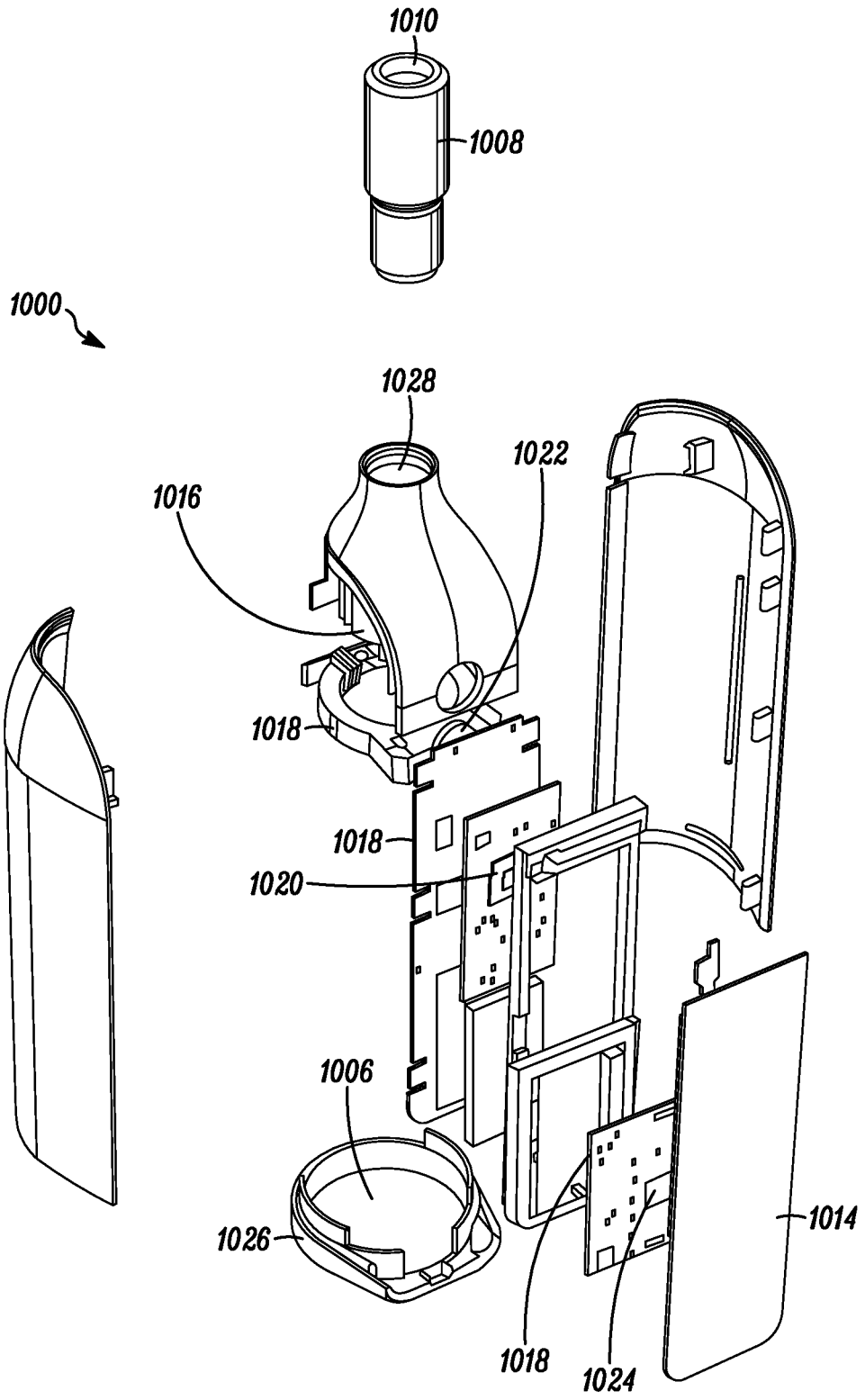
FIG. 10 is an exploded view of a housing for a container system.

FIG. 10 is an exploded view of a housing for a container system. The housing 1000 may include a housing opening 1006, a spout-shaped accessory 1008, a spout opening 1010, a display 1014, a communications device 1016, a sensor 1018, a processor 1020, and a control 1022.

The communications device 1016 may include an RFID receiver, quick response (QR) code reader, or the like. The communications device 1016 may identify and extract information from the container to be inserted into the housing 1000. As shown in the figure, the communications device 1016 may be mounted in close proximity to the top of the inserted rigid container. Other locations are also possible.

The sensor 1018 may include any of the sensors as described herein including without limitation a temperature sensor, a humidity sensor, an accelerometer, an optical sensor, and so forth. The sensor 1018 may be configured to provide specific environmental information related to a fluid in the container, e.g., a beverage for consumption. For instance, a temperature sensor can measure the temperature of the container, either directly or indirectly, e.g., using a contact or non-contact temperature sensing technique. This temperature (or other sensed property) can be compared to the ideal serving temperature of the container, and the housing 1000 can alert the user as to whether or not the beverage is within its ideal serving temperature range. The housing 1000 can also offer a suggested time to wait before the beverage is within the ideal serving temperature range. As shown in the figure, sensors 1018 may be mounted in various locations of the housing 1000, including on the board having the secondary microcontroller 1024. Other locations are also possible.

The housing 1000 or container can also monitor temperature (or other properties) over time. By logging temperature in the container, temperature history may be downloaded and processed by the housing 1000 when the container is inserted so that, e.g., a consumer can be alerted of potentially spoiled or unsafe contents.

In an aspect, a contactless IR temperature sensor is used to simplify mechanical design and potentially increase the longevity of the device. The sensor 1018 may be located relatively low on the container or in a floating device disposed in the fluid in the container in order to measure a liquid temperature even when the fluid level is low.

A variety of other sensors or monitoring functions may also or instead be usefully incorporated into the housing 1000. By way of non-limiting example, the housing 1000 may monitor contents of the container either by direct sensing or by inference based on, e.g., how much has been dispensed. This may be used to display information on the display 1014 relating to, e.g., the number of drinks left in a bottle, the volume of liquid remaining, or any other suitable information relating to the remaining contents. In another aspect, a sensor 1018 may be used to track whether a container has been used before, and if so, when it was first breached, how often it has been removed from and returned to the housing 1000, and so forth. This information can be used to display useful shelf life remaining on the beverage in the container. Other information such as temperature history (as discussed above) may be used to augment this calculation and more accurately predict useful shelf life. For certain beverages, such as unfiltered beverages with sediment or carbonated beverages that can be pressurized by physical agitation, it may be appropriate to determine how long the container has remained still. An accelerometer or other suitable sensor 1018 may be used to track motion of the container or housing 1000 and evaluate whether it might be inappropriate to access a beverage at a particular time.

In one aspect, during pouring, the housing 1000 may use flow rate, tilt angle, previous estimates of remaining beverage in the container, or other information to estimate and update the amount of beverage remaining in the container to present to the user. The housing 1000 may also actively manage measured pours, either in response to user positioning of the housing 1000 or in response to the use of a particular button or other control. For example, the housing 1000 may include a finger operated button (e.g. on the neck or other convenient location) that can be depressed to measure a one ounce tasting pour or a five ounce full glass of wine. Similar buttons may also or instead be provided in the user interface of the display 1014. In another aspect, the housing 1000 may automatically stop a pour with an actuated valve or other mechanism. The pour may, for example, stop after a standard wine glass pour, or the user may control the amount of fluid dispensed in a pour using, e.g., user preferences in the display 1014. The housing 1000 may also or instead provide a user notifications such as an audio, visual, or tactile alerts that a certain pour amount has been reached.

The processor 1020 may be disposed on a circuit board and be configured to work in conjunction with a memory to provide a user interface (UI), e.g., in the display 1014, and to otherwise receive and transmit data and control operation of the housing 1000. The processor 1020 may run on a Linux/Android platform or any other suitable hardware, firmware, or operating system.

The processor 1020 may support content delivery. Various informational assets, e.g., information for display on the smart label described above or usage data gathered from the consumer for communication to a remote server, may be stored locally, such that the content is available in the absence of connectivity. In addition to software upgrades and the like, the housing 1000 may periodically check for updates to the content, which can be downloaded and stored locally as new content is made available. In the same manner, usage data may be relayed back to a server in a periodic or event driven manner such that the user's drinking profile can be kept up to date.

The housing 1000 may also include secondary processing devices including without limitations microcontrollers, co-processors, digital signal processors, and the like. For example, a secondary microcontroller 1024 may be used to gather sensor data, manage power, support signal processing functions, communicate such data to the processor 1020, and so forth. In one aspect, the secondary microcontroller 1024 may be a lower power device relative to the processor 1020 in order to advantageously offload maintenance tasks and lower level functions, such as power management, battery charging, temperature sensing, RFID readings, accelerometer readings, and so forth. The secondary microcontroller 1024 may also monitor an accelerometer or other sensor(s) or device(s) and "wake up" the processor 1020 and other system components when bottle activity is detected, e.g., when the housing 1000 is touched or picked up.

The control 1022 may include a manual control such as a button or the like for various functions as described herein. For example, in one aspect, a user can press (or activate) the control 1022 to initiate a container swap. In an aspect, to swap containers, a user presses the control 1022 on the housing 1000 to eject a container and insert another one. Because of the design of the containers as contemplated herein, full or incomplete containers can be stored as appropriate, either vertically or horizontally.

The control 1022 or another component may also or instead be used to hold the container in place when the housing 1000 is transported and ensure proper sealing between the container and the intended flow path of the liquid through the housing 1000.

The housing 1000 may be powered by a battery or any other suitable electrical energy storage device or system. There are several options for charging a battery, including contact and non-contact solutions. For example, inductive charging may be employed using any suitable wireless coupling technique for short range transmission of power. In another aspect, the housing 1000 may include a Universal Serial Bus (USB) plug for coupling to a USB cable or docking station, which may provide power to the battery through a local charging circuit or the like. In another aspect, a proprietary contact coupling may be provided in a docking station, which may be coupled to an external power source for directly charging the battery or for powering a local charging circuit on the housing 1000, e.g., via a docking station coupling/interface 1026. More generally, any other standardized or proprietary coupling configuration may also or instead be employed to charge the battery as desired.

The housing 1000 may include a housing opening 1028 on its top end, where the housing opening 1028 is disposed along a fluid path of the container to facilitate pouring of the fluid from the interior of the container. The housing opening 1028 may also cooperate with the spout-shaped accessory 1008 for engagement on the housing 1000.

The housing described above with reference to the figures may actively or passively open the container in a variety of manners. For example, the housing may simply open the container when the container is inserted into the housing, and keep the container open until it is removed, or the housing may provide a manual opening/closing mechanism to open and close the container. In another aspect, the housing may actively (e.g., with sensors and actuators) or passively (e.g. through a non-powered switch or other mechanism) open and close in response to pouring motions, e.g., when the housing is tipped or when pressure is exerted on a valve or the like. This permits the housing to pour naturally while also closing during non-use to limit oxygen exposure and preserve shelf-life. In one aspect, the housing may mimic the natural pouring behavior of an opened bottle or beverage container, so that no additional or unnatural motions or actions are required from a user other than tipping the housing to pour, or possibly tipping the housing in combination with activating a button or other control. In another aspect, the housing may include a spill-proof mechanism. This may, for example, be a passive mechanical system that seals automatically when the housing rapidly changes position, or this may be an electromechanical system using inertial sensors or the like to detect motion that is associated with accidental tipping or the like, and to actively seal the container during suspected accidents.

Figure 11:
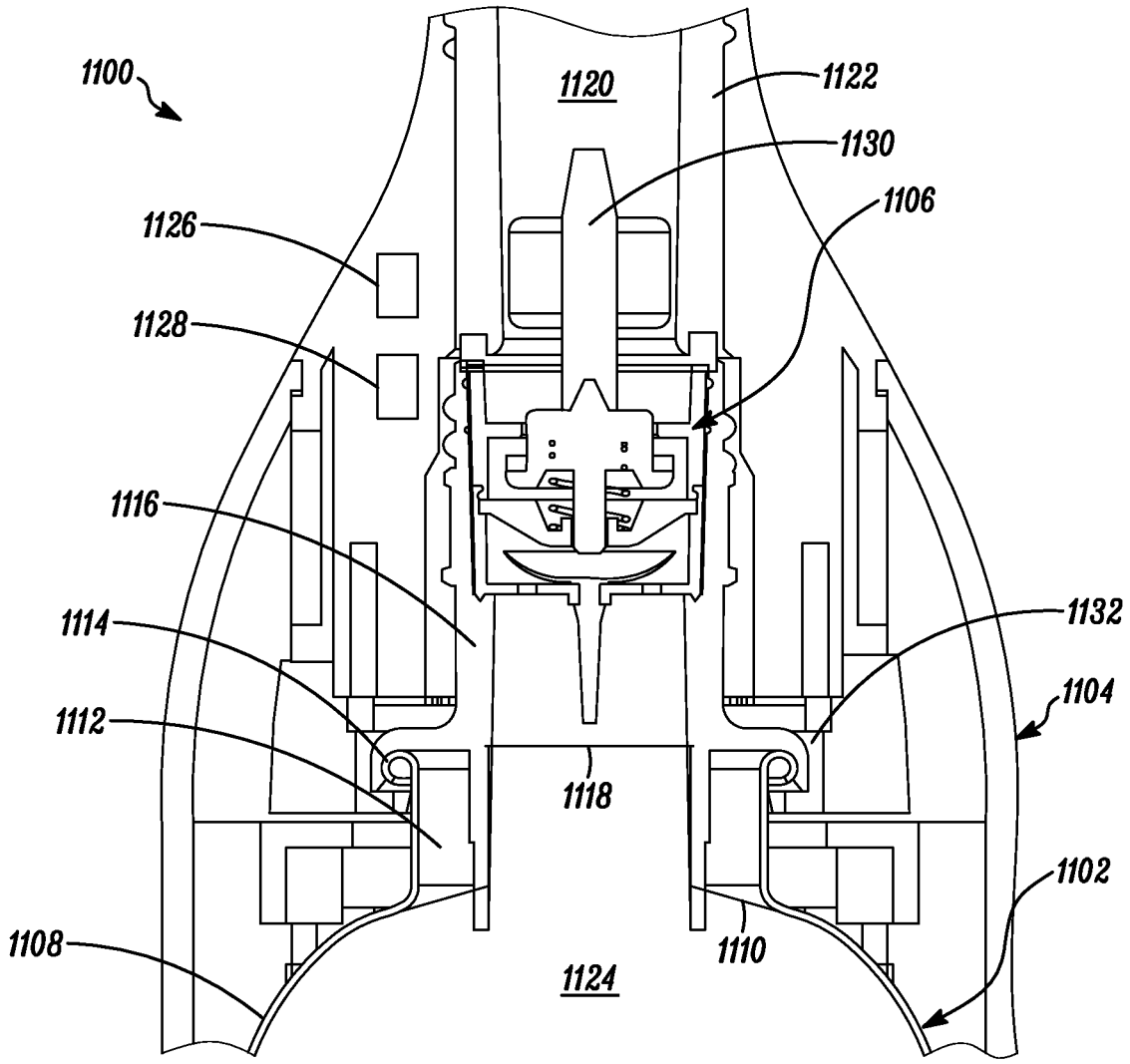
FIG. 11 is a close-up cross sectional view of the top of a container system.

FIG. 11 is a close-up cross sectional view of the top of a container system. As discussed herein, the container system 1100 may include a container 1102 and a housing 1104 that cooperate to form a preserving system for a fluid (e.g., wine) that can maintain longevity of the fluid, pour the fluid while resisting backflow, and perform other 'smart' features. Specifically, the container system 1100 of FIG. 11 shows the engagement of the container 1102 to the housing 1104, where proper seals are formed such that activation of the valve 1106 can be achieved, enabling a fluid to be dispensed from the container 1102.

The container 1102 may be any as discussed herein, and may include a rigid container 1108 and a flexible container 1110. The rigid container 1108 may include a first opening 1112 having a collar 1114 that engages with a neck 1116, where the neck 1116 is engaged with the flexible container 1110 forming a fluid pathway through a second opening 1118 thereof.

The housing 1104 may be configured for engagement with the container 1102. The engagement between the housing 1104 and the container 1102 may be through any known means in the art including without limitation a snap fit, an interference fit, a clasp, a latch, a screw fit, and so forth. The engagement between the housing 1104 and the container 1102 may allow for the spout opening 1120 of a spout-shaped accessory 1122 on the housing 1104 to be in fluid communication with the interior 1124 of the flexible container 1110 through the neck 1116, i.e., as permitted by the valve 1106.

In one aspect, when the container 1102 is inserted into the housing 1104, a mechanism 1132 mechanically holds the container 1102 in place in such a manner that the container 1102 does not fall out accidentally during pouring and other handling of the container system 1100. The mechanism 1132 may also or instead ensure a proper seal between the container 1102 and housing 1104 such that no liquid leaks beyond the intended flow path during dispensing and no air infiltrates the interior 1124 of the container 1102. It will be understood that these three functions of preventing air infiltration, maintaining a fluid path, and mechanically retaining the container 1102 in the housing 1104, may be performed collectively by a single mechanism or by several different mechanisms operating independently or collectively.

In another aspect, a guillotine design is employed to hold the container 1102 in place. In this configuration, a ring, collar, clasp, or similar may hold the container 1102 in place until the user dispenses the container 1102 from the housing 1104, e.g., through a user interface on a display of the housing 1104 or by manually pressing a button or the like on the housing 1104, which releases the mechanism and disengages the container 1102.

The housing 1104 may form a sealed path for dispensing the fluid contained in the container 1102. In particular, the spout-shaped accessory 1122 may interface with the top of the container 1102 to create a sealed path to pour the fluid from the interior 1124.

The valve 1106 of the container 1102 can be passively or actively actuated by the housing 1104 to enable pouring of the fluid while maintaining a natural pouring action for a user. For example, in an aspect, the housing 1104 includes a valve control 1126 including a sensor 1128 configured to detect a valve condition and an actuator 1130 to open or close the valve 1106 in response to the valve condition. The valve condition may depend upon a tilt angle being achieved, user input through an interface on the housing 1104 or a mechanical control, a sensed condition of the container 1102 or the fluid disposed therein, and so forth. In an aspect, the valve 1106 is automatically opened when the container system 1100 is in a pouring position, and closed when in an upright position. In this manner, the container system 1100 may provide a natural experience of pouring a beverage without requiring the operator to do anything beyond what is required to pour a standard bottle.

One of ordinary skill will recognize that other means for automatically opening and closing the valve 1106 in response to a valve condition or a container condition are also possible and are intended to fall within the scope of this disclosure.

In another aspect, a manually activated open and close feature such as a twist of the top of the housing 1104, a button on the housing 1104, or any other control feature, may be provided such that a user can manually open and close the valve 1106.

The housing 1104 may include a stopper or the like that can be inserted to protect contaminants from entering the housing 1104 or container 1102.

Figure 12:
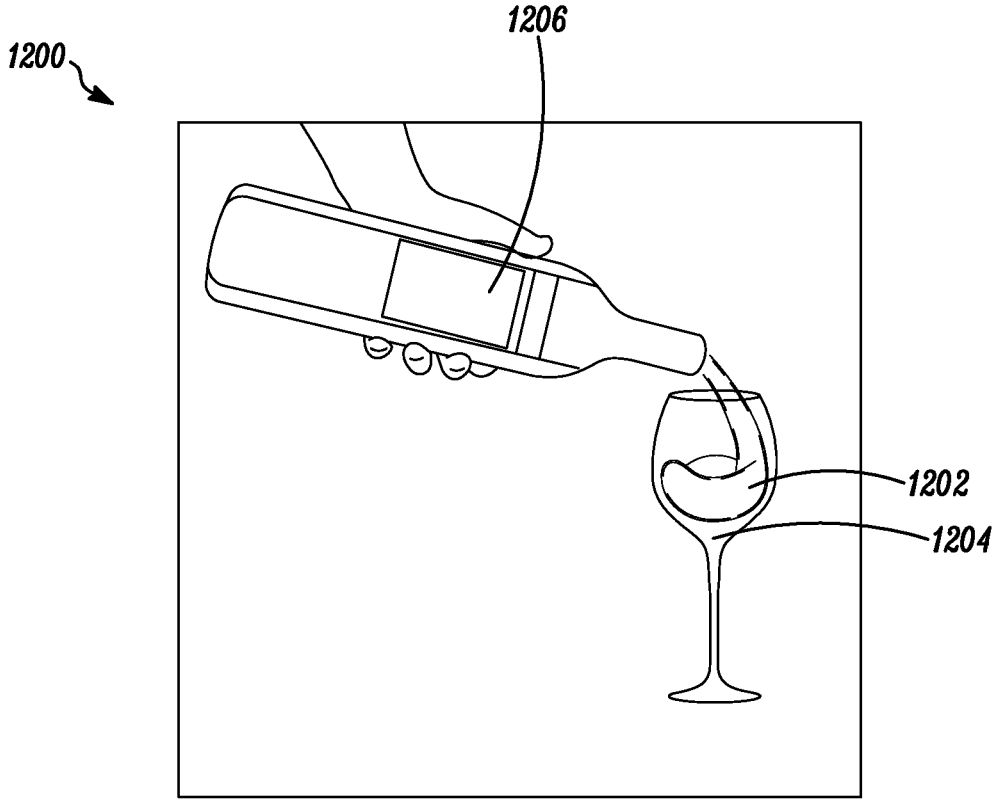
FIG. 12 illustrates a container system in use.

FIG. 12 illustrates a container system in use. Specifically, the container system 1200 is being tilted at or above a predetermined tilt angle to allow for the pouring of wine 1202 into a glass 1204. The display 1206 in FIG. 12 shows the label from the bottle that contained the wine 1202 being poured by the container system 1200.

The results of the container system discussed above, i.e., using the combination of the container and the housing, may also be achieved independently through either the container or the housing. One or more of the container and the housing may also or instead rely on an external mechanism that interfaces with and actuates a valve on the container or the housing.

It may be useful for the container systems described herein to have an estimate of how much beverage is remaining, particularly where the housing or container is opaque and thus precludes visual inspection. To perform this estimation, the flow rate of the beverage out of the container system can be estimated based upon the remaining beverage and the tilt angle of the container system using any suitable physical or empirical model for a particular valve configuration. These flow rates may be integrated over time during pours to predict how much beverage has been poured out during a single pour. This amount may then be subtracted from the known total remaining in the container system. In one aspect, the containers can be assumed to start completely full and further assumed to be only used with a specific housing so that the container system can independently estimate usage. In another aspect, the amount of beverage can be stored on an RFID tag on the container, and updated in any suitable manner such as after each pour or whenever the container is removed from the housing.

X, Y, and Z axis acceleration data can be provided by an accelerometer on the container system. Using this data and knowing an orientation of X, Y, and Z axes relative the container system, the pitch can be calculated using the equation below.

$$\alpha = \frac{y}{\sqrt{x^2 + z^2}}$$

This equation is dependent on accelerometer orientation in the container system, and can change based on this orientation. As such, it is preferred that the accelerometer remain firmly fixed in place.

The X, Y, and Z acceleration vectors may be read in by a microprocessor and the pitch calculation may be performed on board the microcontroller.

The 'pouring profile,' which is a characterization of the amount of beverage being poured out of a container system at a given fixed angle can thus be characterized. Several examples are discussed below.

Figure 13:
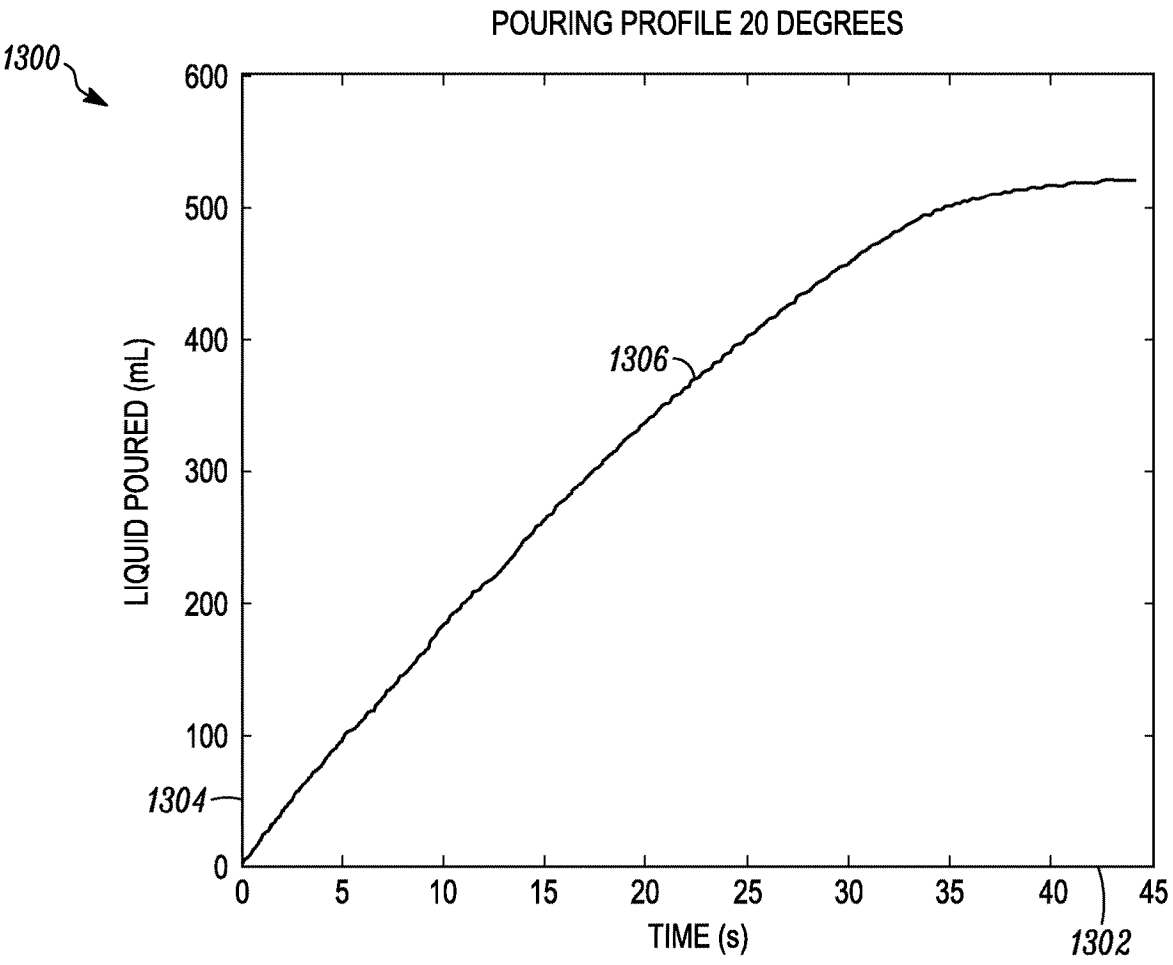
FIG. 13 shows a graph representing a pouring profile for a negative 20 degree tilt angle of a container.

FIG. 13 shows a graph representing a pouring profile for a negative 20 degree tilt angle of a container. In the graph 1300 of FIG. 13, the x-axis 1302 represents the time in seconds (s) and the y-axis 1304 represents the amount of liquid poured from a container system in milliliters (mL). The line 1306 shows the relationship between the amount of liquid being poured out of a container system over time at the 20 degree tilt angle.

The derivative of the line 1306 in FIG. 13 is the flow rate of the beverage being poured out of the container system in mL/s. The numeric derivative of this data can easily be calculated to yield a curve characterizing flow rate (mL/s) at a given angle over time.

Also, because the relationship between time and the amount of liquid poured out of a container system can be measured, a relationship between flow rate (mL/s) and the amount of liquid poured out can be determined, as shown in the figure discussed below.

Figure 14:
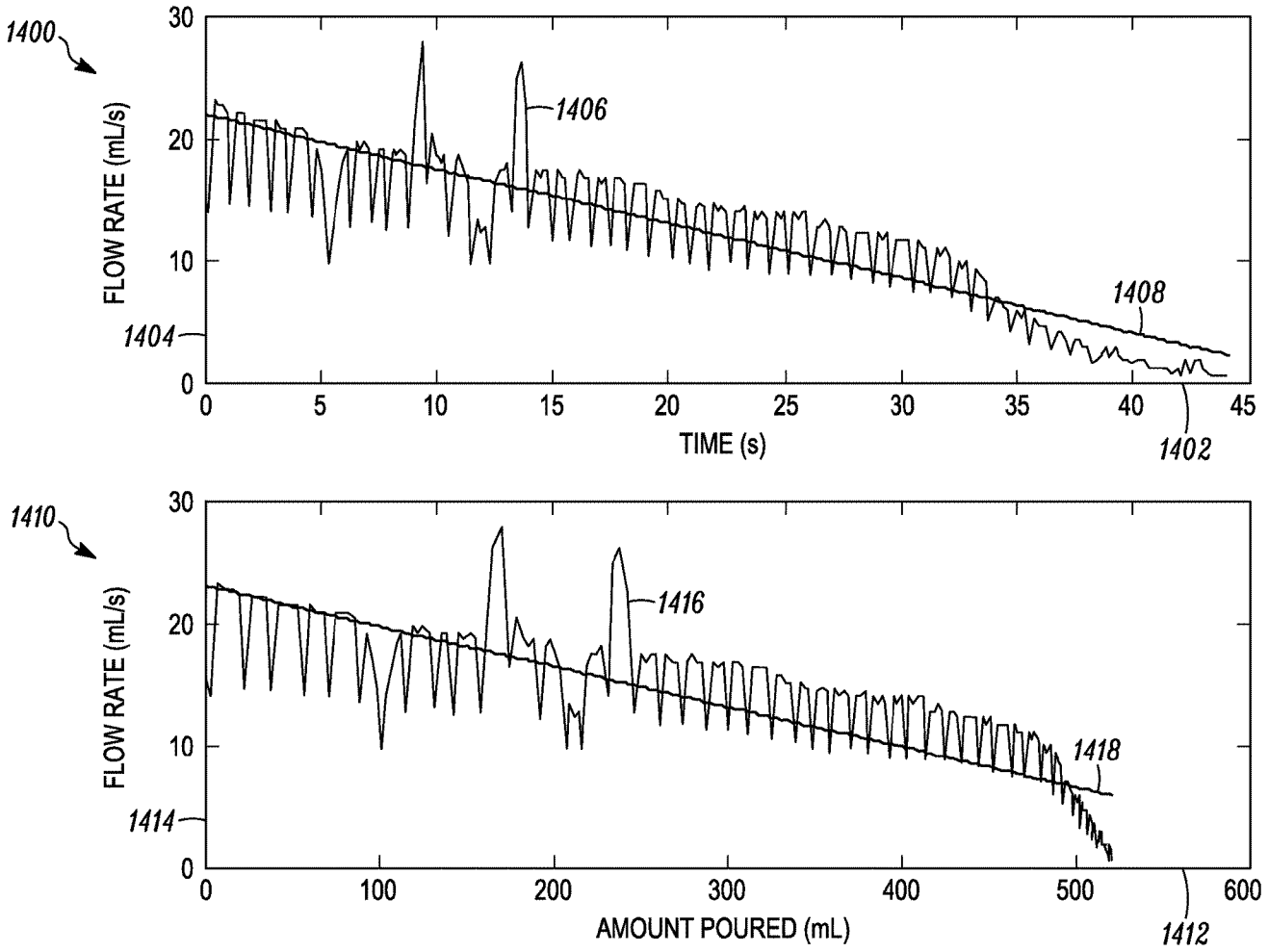
FIG. 14 shows a first graph representing flow rate versus time and a second graph representing flow rate versus amount poured for a container.

FIG. 14 shows a first graph representing flow rate versus time and a second graph representing flow rate versus amount poured for a container.

In the first graph 1400 of FIG. 14, the x-axis 1402 represents the time in seconds (s) and the y-axis 1404 represents flow rate in milliliters per second (mL/s) of a container system. The first line 1406 shows the relationship between the flow rate of a container system over time at a 20 degree tilt angle, and the second line 1408 represents a best fit.

In the second graph 1410 of FIG. 14, the x-axis 1412 represents the amount poured in milliliters (mL) and the y-axis 1414 represents flow rate in milliliters per second (mL/s) of a container system. The third line 1416 shows the relationship between the flow rate of a container system relative to an amount poured at a 20 degree tilt angle, and the fourth line 1418 represents a best fit.

As shown by FIG. 14, a secondary correlation exists between the flow rate and the residual beverage in the container system. This is equivalent to saying that the flow rate decreases as the amount of beverage being poured out increases, which is what is shown in FIG. 14.

Several pouring profiles at different fixed angles can be constructed, and a regression can be run on each individual one, yielding a best fit equation describing the relationship between flow rate and residual liquid at a given fixed angle. For instance, at each angle measured, a polynomial equation in the form y=mx+b can be fitted to the data measured.

These m and b coefficients vary from angle to angle, but when they are plotted versus the sine of their corresponding angles, a linear correlation can be found, as shown in the figure discussed below.

Figure 15:
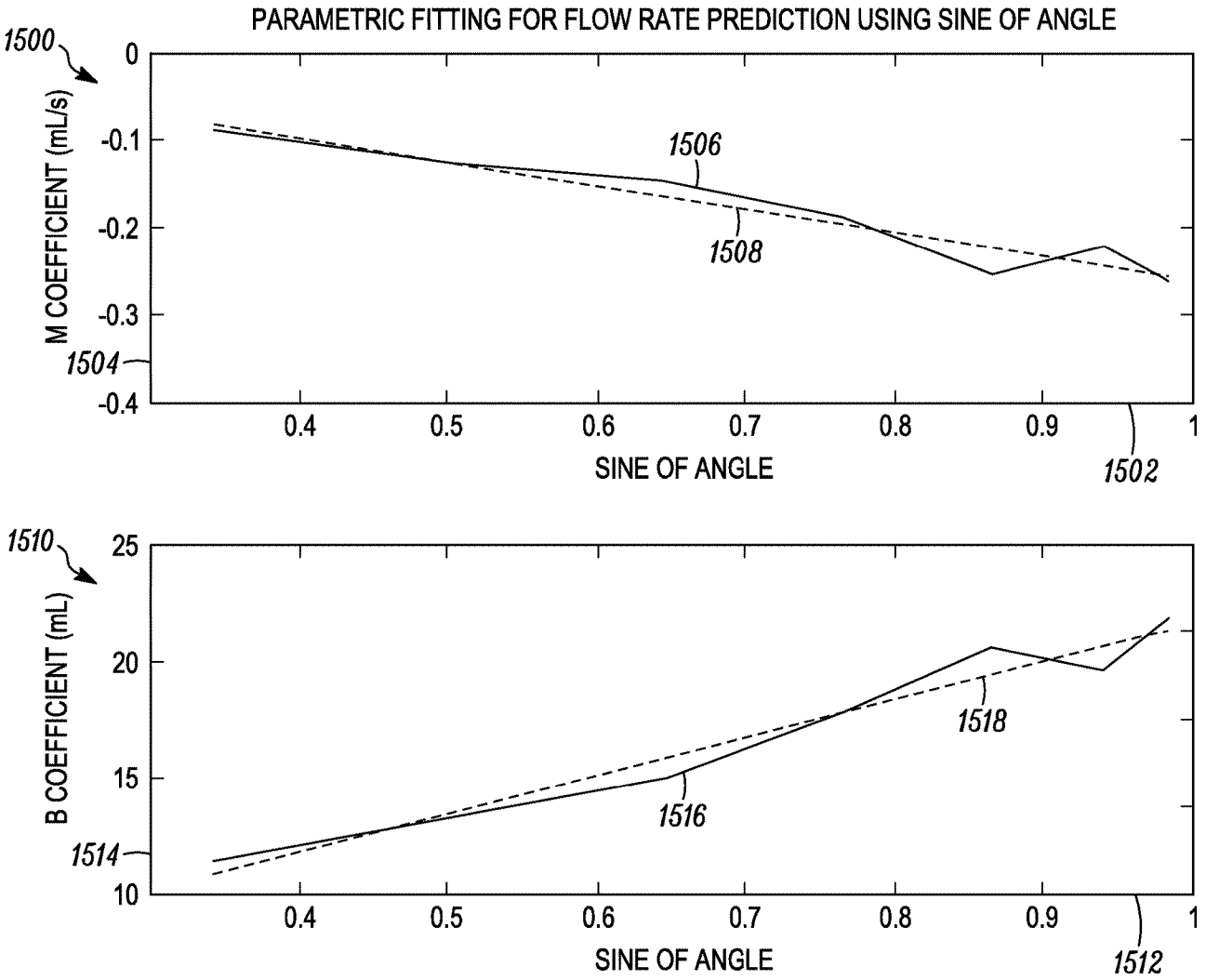
FIG. 15 shows graphs representing parametric fitting for flow rate prediction using sine of angle.

FIG. 15 shows graphs representing parametric fitting for flow rate prediction using sine of angle. In this figure, the coefficients from the flow rate versus the amount poured data are shown.

In the first graph 1500 of FIG. 15, the x-axis 1502 represents the sine of the angle and the y-axis 1504 represents the M coefficient (mL/s) of a container system. The first line 1506 shows the relationship between the M coefficient of a container system relative to the sine of its corresponding angle, and the second line 1508 (i.e., the dotted line) represents a best fit.

In the second graph 1510 of FIG. 15, the x-axis 1512 represents the sine of the angle and the y-axis 1514 represents the B coefficient (mL) of a container system. The third line 1516 shows the relationship between the B coefficient of a container system relative to the sine of its corresponding angle, and the fourth line 1518 (i.e., the dotted line) represents a best fit.

Using the best fit lines pictured in FIG. 15, the coefficients related to the liquid flow rate out of the container system at a given angle and amount of liquid remaining can be calculated.

The equations for the lines in FIG. 15 (that solve for the m and b coefficients of the previously described line that characterizes flow rate) can be programmed into the microcontroller or processor described above, and using these techniques, the angle can be solved for. Assuming that the container inserted into the housing is filled to a known initial level, the flow rate of liquid can be predicted as the user begins to pour the liquid out.

Using an iterative approach, an estimate of beverage remaining can be computed. For example, if the container starts at with 0 mL poured out, and it is tilted to 20 degrees, the flow rate can be calculated by using the lines in FIG. 15. If it is assumed that the bottle is held at this angle for a discrete period of time (e.g., 0.01 seconds), the microcontroller can simply multiply the calculated flow rate in that interval by this discrete period of time to find how much liquid has been poured out. The microcontroller may then measure the tilt again, and solve for the new flow rate using the updated tilt angle and amount of liquid remaining, and again multiply by the discrete period of time over which the calculated flow rate is considered valid. This approach may be repeated over the life of the container to attain a reasonable, passive approximation of how much liquid is remaining.

The latest estimated amount of liquid left in a container may be recorded at the end of a pour to be used as the starting point for the next set of calculations, and also to give a real time indicator of how much liquid is remaining in the container (e.g., expressed through a set of LEDs on the housing, or otherwise shown on the display).

It will be appreciated that the above mathematical derivation and other graphical depictions are provided by way of example only. Depending on the shape of the container, properties of any internal flexible container or sealing container, and the shape and mechanics of the valve, as well as numerous other factors, the actual behavior may vary significantly.

In another aspect, other techniques may be used to measure the remaining liquid including without limitation optical analysis of the interior of the container or fluids therein, weight of the container (which may be measured, e.g., using a suitable arrangement of pressure sensors, piezoelectric elements, or the like), and so forth.

Advantages of the systems and devices discussed herein may include extended preservation of contents, the ability to be filled in a traditional bottling line, low headroom air that leads to low sulphite contents (similar to, or below that of a glass bottle), the ability to include a 750 ml bottle size, aesthetically pleasing bottle packaging, long shelf life and drinking life, and so forth.

Additionally, the systems and devices may enhance the ability of a consumer to appreciate the story of the beverage, which can be richly retold through any suitable multimedia using the display capabilities of the 'smart' system. Additional benefits may include guidance on a proper serving (e.g., proper temperature and suitable breathing time), accurate serving sizes through free or measured pours, shopping assistance (e.g., through purchasing from a user interface), and targeted information such as promotions, offers, and recommendations based on user profile and drinking profile. For a beverage producer, benefits may include access to user demographics and drinking data, as well as the ability to communicate a rich story for the beverage beyond the label.

The above systems, devices, methods, kits, processes, and the like may be realized in hardware, software, or any combination of these suitable for a particular application. The hardware may include a general-purpose computer and/or dedicated computing device. This includes realization in one or more microprocessors, microcontrollers, embedded microcontrollers, programmable digital signal processors or other programmable devices or processing circuitry, along with internal and/or external memory. This may also, or instead, include one or more application specific integrated circuits, programmable gate arrays, programmable array logic components, or any other device or devices that may be configured to process electronic signals. It will further be appreciated that a realization of the processes or devices described above may include computer-executable code created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software. In another aspect, the methods may be embodied in systems that perform the steps thereof, and may be distributed across devices in a number of ways. At the same time, processing may be distributed across devices such as the various systems described above, or all of the functionality may be integrated into a dedicated, standalone device or other hardware. In another aspect, means for performing the steps associated with the processes described above may include any of the hardware and/or software described above. All such permutations and combinations are intended to fall within the scope of the present disclosure.

Embodiments disclosed herein may include computer program products comprising computer-executable code or computer-usable code that, when executing on one or more computing devices, performs any and/or all of the steps thereof. The code may be stored in a non-transitory fashion in a computer memory, which may be a memory from which the program executes (such as random access memory associated with a processor), or a storage device such as a disk drive, flash memory or any other optical, electromagnetic, magnetic, infrared or other device or combination of devices. In another aspect, any of the systems and methods described above may be embodied in any suitable transmission or propagation medium carrying computer-executable code and/or any inputs or outputs from same.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So for example performing the step of X includes any suitable method for causing another party such as a remote user, a remote processing resource (e.g., a server or cloud computer) or a machine to perform the step of X. Similarly, performing steps X, Y and Z may include any method of directing or controlling any combination of such other individuals or resources to perform steps X, Y and Z to obtain the benefit of such steps. Thus method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A device comprising:

a rigid container formed as a bottle having a top, a bottom, and a first opening on the top;

a flexible container inside the rigid container having a second opening aligned to the first opening to provide a fluid path from an interior of the flexible container through the first opening of the rigid container to an exterior environment;

a valve along the fluid path between the interior of the flexible container and the exterior environment, the valve opening to pour a fluid from the interior of the flexible container at or above a predetermined tilt angle of the rigid container, wherein the predetermined tilt angle varies according to an amount of the fluid in the interior of the flexible container, and wherein the valve self-seals to resist a backflow of air when the rigid container returns to a tilt angle below the predetermined tilt angle;

a vent in the rigid container to permit ingress of atmospheric air into the rigid container as the fluid leaves the flexible container; and a removable seal comprising an oxygen scavenger disposed over the vent in the rigid container, the removeable seal hermetically sealing the vent prior to use.

2. The device of claim 1 wherein the predetermined tilt angle varies to prevent a backflow of air from the exterior environment into the interior of the flexible container during pouring.

3. The device of claim 1 wherein the valve is a passive valve that opens at a cracking pressure selected to ensure that an opening of the valve along the fluid path is fully flooded whenever the valve is open during a pour.

4. The device of claim 1 wherein the valve includes an umbrella valve.

5. The device of claim 1 further comprising a second valve operable to close the fluid path when the device is not in use.

6. The device of claim 1 wherein the predetermined tilt angle is about three degrees from horizontal for a first pour when the interior is full.

7. The device of claim 1 wherein the predetermined tilt angle increases as the amount of the fluid in the interior of the flexible container decreases, thereby providing a natural pour for the fluid mimicking a pouring behavior of a conventional wine bottle.

8. The device of claim 1 wherein the flexible container includes a first liner having an oxygen permeability selected to reduce oxygen diffusion into the interior, and a second liner providing an inert layer for contact with a beverage.

9. The device of claim 1 wherein the device is shaped and sized to substantially reproduce a 750 ml wine bottle.

10. The device of claim 1 wherein the vent is located at the top of the rigid container.

11. The device of claim 1 wherein the valve is a passive valve that opens at a cracking pressure, the device further comprising a second valve operable to control a pour through the fluid path.

12. The device of claim 11 wherein the second valve manually operates to close the fluid path when the device is not in use.

13. The device of claim 11 wherein the second valve operates to automatically control a pour through the fluid path in response to a sensed condition.

14. The device of claim 1 wherein the rigid container includes a neck shaped and sized to be filled in a wine bottling line.

15. The device of claim 14 wherein the interior of the flexible container contains a wine, and the interior of the flexible container is substantially filled to provide a headroom of air sufficient to eliminate a need for fortifying sulfites.

16. The device of claim 14 wherein the neck includes an airtight screw cap disposed over the first opening in the top of the rigid container and press fit by a wine bottling system to conform to an exterior surface of the neck.

17. The device of claim 1 wherein the valve is an active valve operable to automatically open the fluid path when the tilt angle exceeds a predetermined tilt angle selected to ensure that an opening of the valve along the fluid path is fully flooded.

18. The device of claim 17 wherein the valve includes a poppet valve.

19. The device of claim 17 further comprising a control mechanism integrated into the rigid container and operable to manually open the active valve during a pour.

20. The device of claim 17 further comprising a processor configured to determine the amount of the fluid and calculate the predetermined tilt angle, the processor further configured to detect an actual tilt angle and operate the valve according to the actual tilt angle and the predetermined tilt angle.

21. The device of claim 1 further comprising a housing shaped and sized to receive the rigid container, the rigid container removably and replaceably coupled to the housing, and the housing including a third opening along the fluid path to facilitate pouring of the fluid from the interior.

22. The device of claim 21 wherein the housing encloses a majority of the rigid container.

23. The device of claim 21 wherein the housing includes a spout-shaped accessory removably and replaceably coupled to the rigid container, the spout-shaped accessory shaped and sized to attach to and enclose the first opening of the rigid container, and the spout-shaped accessory including a fourth opening along the fluid path to facilitate pouring of the fluid from the interior.

24. The device of claim 21 wherein the housing includes a control to manually open and close the valve.

25. The device of claim 21 wherein the housing includes a valve control including a sensor configured to detect a valve condition and an actuator to open or close the valve in response to the valve condition.

26. The device of claim 1 further comprising an airtight screw cap disposed over the first opening in the top of the rigid container.

27. The device of claim 26 wherein the fluid is a wine having a sulfite content comparable to wine in a glass bottle.

28. The device of claim 27 wherein the device is configured to maintain a decay of free sulfur dioxide in the wine less than thirty percent and an amount of dissolved oxygen in the wine less than one milligram per liter in a first twelve months after the airtight screw cap is placed on the rigid container to seal the interior.

29. The device of claim 28 wherein the device is configured to maintain a decay of free sulfur dioxide in the wine less than sixty percent and an amount of dissolved oxygen in the wine less than one milligram per liter in a first two weeks after removing the airtight screw cap and pouring a serving of the wine from the interior.

* * * * *